US010599057B2

(12) United States Patent
Fujii et al.

(10) Patent No.: US 10,599,057 B2
(45) Date of Patent: Mar. 24, 2020

(54) ELECTROPHOTOGRAPHIC PHOTORECEPTOR, ELECTROPHOTOGRAPHIC PHOTORECEPTOR CARTRIDGE AND IMAGE FORMING APPARATUS

(71) Applicant: Mitsubishi Chemical Corporation, Chiyoda-ku (JP)

(72) Inventors: Akiteru Fujii, Tokyo (JP); Yuka Nagao, Tokyo (JP); Wataru Miyashita, Tokyo (JP)

(73) Assignee: Mitsubishi Chemical Corporation, Chiyoda-ku (JP)

( * ) Notice: Subject to any disclaimer, the term of this patent is extended or adjusted under 35 U.S.C. 154(b) by 0 days.

(21) Appl. No.: 16/368,121

(22) Filed: Mar. 28, 2019

(65) Prior Publication Data

US 2019/0219937 A1 Jul. 18, 2019

Related U.S. Application Data

(63) Continuation of application No. PCT/JP2017/035579, filed on Sep. 29, 2017.

(30) Foreign Application Priority Data

Sep. 29, 2016 (JP) ..... 2016-191959

(51) Int. Cl.
*G03G 5/047* (2006.01)
*G03G 5/05* (2006.01)
*G03G 5/06* (2006.01)

(52) U.S. Cl.
CPC ..... *G03G 5/047* (2013.01); *G03G 5/056* (2013.01); *G03G 5/0564* (2013.01);
(Continued)

(58) Field of Classification Search
CPC .... G03G 5/0614; G03G 5/056; G03G 5/0564; G03G 5/047; G03G 5/0596
See application file for complete search history.

(56) References Cited

U.S. PATENT DOCUMENTS 7,125,633 B2 * 10/2006 Mishra ..... G03G 5/047 430/58.3
2004/0063014 A1 * 4/2004 Yoshimura ..... G03G 5/0535 430/59.6

(Continued)

FOREIGN PATENT DOCUMENTS

EP 0 744 666 A2 11/1996
EP 0 744 666 A3 11/1996

(Continued)

OTHER PUBLICATIONS

English language machine translation of JP 07-128872 (May 1995).*

(Continued)

*Primary Examiner* — Christopher D Rodee
(74) *Attorney, Agent, or Firm* — Oblon, McClelland, Maier & Neustadt, L.L.P.

(57) ABSTRACT

An electrophotographic photoreceptor that includes a conductive support; and at least a charge generation layer and a charge transport layer on the conductive support, where the charge transport layer includes at least two layers of a first charge transport layer which is an outermost layer and a second charge transport layer which is in contact with the first charge transport layer, such that the elastic deformation ratio of a binder resin A contained in the first charge transport layer is T1(%) and the elastic deformation ratio of a binder resin B contained in the second charge transport layer is T2(%) such that T1 and T2 satisfy a relationship of $\{0 \leq (T1-T2) \leq 4\}$, the first charge transport layer contains a charge transport material α having a molecular weight of (Continued)

600 or more, and the binder resin A and the binder resin B have different monomer units from each other.

9 Claims, 2 Drawing Sheets

(52) U.S. Cl.
CPC ..... *G03G 5/0592* (2013.01); *G03G 5/0596* (2013.01); *G03G 5/0614* (2013.01)

(56) References Cited

U.S. PATENT DOCUMENTS

| | | | | |
|---|---|---|---|---|
| 2006/0019185 | A1 | 1/2006 | Amamiya et al. | |
| 2007/0105031 | A1 | 5/2007 | Fukushima et al. | |
| 2009/0086308 | A1* | 4/2009 | Okuyama | G02F 1/167 359/296 |
| 2009/0185821 | A1 | 7/2009 | Iwamoto et al. | |
| 2009/0325096 | A1* | 12/2009 | Wu | G03G 5/0535 430/58.85 |
| 2013/0344423 | A1* | 12/2013 | Fujii | G03G 5/047 430/56 |
| 2015/0168856 | A1* | 6/2015 | Kurimoto | G03G 5/144 430/56 |

FOREIGN PATENT DOCUMENTS

| | | | |
|---|---|---|---|
| JP | 07128872 | A * | 5/1995 |
| JP | 8-106166 | | 4/1996 |
| JP | 9-15878 | | 1/1997 |
| JP | 2000-98643 | | 4/2000 |
| JP | 2004-252066 | | 9/2004 |
| JP | 2005-134709 | | 5/2005 |
| JP | 2007-102072 | | 4/2007 |
| JP | 2007-108311 | | 4/2007 |
| JP | 2007-148380 | | 6/2007 |
| JP | 2009-75246 | | 4/2009 |
| JP | 2009-186984 | | 8/2009 |
| JP | 2010-224304 | | 10/2010 |
| JP | 2011-64904 | | 3/2011 |
| JP | 2011-95649 | | 5/2011 |
| JP | 2013-213908 | | 10/2013 |
| JP | 2017-156518 | | 9/2017 |
| JP | 2017156518 | A * | 9/2017 |
| WO | WO 2005/093520 | A1 | 10/2005 |

OTHER PUBLICATIONS

English language machine translation of JP2017-156518 (Sep. 2017).*
English language machine translation of JP 2004-252066 (2004).*
International Search Report dated Jan. 9, 2018 in PCT/JP2017/035579, filed on Sep. 29, 2017 (with English Translation).
Written Opinion dated Jan. 9, 2018 in PCT/JP2017/035579, filed on Sep. 29, 2017.

* cited by examiner

ELECTROPHOTOGRAPHIC PHOTORECEPTOR, ELECTROPHOTOGRAPHIC PHOTORECEPTOR CARTRIDGE AND IMAGE FORMING APPARATUS

TECHNICAL FIELD

The present invention relates to an electrophotographic photoreceptor having excellent abrasion resistance, electrical properties and adhesiveness, and an electrophotographic photoreceptor cartridge and an image forming apparatus including the electrophotographic photoreceptor.

BACKGROUND ART

Electrophotographic technology is widely used in a copying machine, a printer, and a printing machine since immediacy and high quality images can be obtained. Regarding electrophotographic photoreceptors (hereinafter, appropriately referred to as simply "photoreceptor"), which are the core of electrophotography technology, photoreceptors employing an organic photoconductive substance having advantages such as non-pollution, ease of film formation, and ease of production has been widely used in recent years.

In a case where the number of guaranteed sheets of an image forming apparatus is large, high repeat durability is also required for the photoreceptor. In order not to change the image quality over a long period of time, there is a need to reduce abrasive properties of the photosensitive layer and to prevent accumulation of surface adhered substances. In a case where a curing protective layer is provided, the abrasion resistance is improved, while no reface due to abrasion on the surface is made, so that adhered substances such as corona products, developers, and paper dust cannot be completely cleaned and tend to remain and accumulate. In the case where a curing protective layer is provided, dedicated production equipment is required, deterioration in coating liquid (insufficient storage stability) and deterioration in electrical properties also occur due to the functional group contributing to curing, and actually it is difficult to use it for ones other than high-end models.

In order to improve the durability without providing a curing protective layer, it is general practice to increase the abrasion resistance of the outermost charge transport layer. However, from the viewpoint that the abrasion resistance is not necessarily required for the entire film thickness of the charge transport layer, when the charge transport layer is formed as a plurality of layers, it is considered that electrical properties and adhesiveness other than abrasion resistance are regarded as important for the charge transport layer on the side close to the support, and abrasion resistance is applied predominantly for the charge transport layer of an outermost layer. Generally, a binder resin which constitutes a charge transport layer and has excellent abrasion resistance often has inferior electrical properties and adhesiveness, so that many ideas that such functional separation is effective are disclosed many times before.

As a proposal to improve abrasion resistance by a plurality of charge transport layers, Patent Literature 1 discloses an electrophotographic photoreceptor containing inorganic particles only in a first charge transport layer which is an outermost layer. In addition, Patent Literature 2 discloses an example in which a high molecular weight binder resin is used only for a first charge transport layer which is an outermost layer. Patent Literature 3 discloses a technique of increasing the hardness and elastic deformation ratio of a first charge transport layer which is an outermost layer. Patent Literature 4 discloses a technique of using a polyester resin having a specific structural unit in a first charge transport layer which is an outermost layer. Patent Literature 5 discloses a technique of forming layers in which a first charge transport layer as an outermost layer is excellent in scratch resistance and a second charge transport layer in contact with the first charge transport layer is excellent in potential stability and gas resistance, by using a copolymer resin where a plurality of charge transport layers have different units from each other and common units. In addition, unlike Patent Literatures 1 to 5, Patent Literature 6 discloses a technique for suppressing long-term image quality deterioration by using a binder resin having a higher molecular weight in a second charge transport layer in contact with a first charge transport layer which is an outermost layer and by increasing the film thickness of both end portions which are easy to abrade.

CITATION LIST

Patent Literature

Patent Literature 1: JP-A-H9-15878
Patent Literature 2: JP-A-H9-43887
Patent Literature 3: JP-A-2007-148380
Patent Literature 4: JP-A-H8-106166
Patent Literature 5: JP-A-2011-95649
Patent Literature 6: JP-A-2009-75246

SUMMARY OF INVENTION

Technical Problem

However, according to the study of the inventors, as described in Patent Literatures 1 to 5, it is found that in the case of attempting to improve abrasion resistance only for the first charge transport layer which is the outermost layer among a plurality of charge transport layers, the desired abrasion resistance not always can be obtained, but rather the abrasion resistance is sometimes significantly deteriorated as compared with the case of attempting to improve the abrasion resistance of this charge transport layer which is a single layer. Particularly in a case where the binder resin having inferior abrasion resistance is used for the second charge transport layer in contact with the first charge transport layer which is the outermost layer, the abrasion resistance tends to be inferior, and the abrasion resistance of the charge transport layer on the outermost layer side also deteriorates.

Although the reason is not clear, for example, when the second charge transport layer in contact with the first charge transport layer has a low elastic deformation ratio even if a binder resin having a high elastic deformation ratio is used for the first charge transport layer which is the outermost layer, it is considered that the elastic deformation ratio of the total charge transport layer is influenced by the plastic deformation of the second charge transport layer and does not become high.

The present invention has been made in consideration of the above background art, and aims to provide an electrophotographic photoreceptor including a charge transport layer and being excellent in electrical properties and adhesiveness while exhibiting sufficient abrasion resistance indispensable for prolonging the life of the electrophotographic photoreceptor, and an electrophotographic photoreceptor cartridge and an image forming apparatus including the electrophotographic photoreceptor.

Solution to Problem

The inventors have conducted intensive studies, and as a result, it is found that, an electrophotographic photoreceptor having sufficient abrasion resistance indispensable for long life use and excellent in electrical properties and adhesivcncss can be provided by setting an elastic deformation ratio of a binder resin contained in a first charge transport layer which is an outermost layer and an elastic deformation ratio of a binder resin contained in a second charge transport layer which is in contact with the first charge transport layer to satisfy a predetermined relationship in an electrophotographic photoreceptor including at least two charge transport layers. The present invention as follows has been completed.

That is, summary of the present invention lies in the following [1] to [11].

[1] An electrophotographic photoreceptor comprising:

a conductive support; and at least a charge generation layer and a charge transport layer on the conductive support, wherein the charge transport layer includes at least two layers of a first charge transport layer which is an outermost layer and a second charge transport layer which is in contact with the first charge transport layer, when an elastic deformation ratio of a binder resin A contained in the first charge transport layer is T1(%) and an elastic deformation ratio of a binder resin B contained in the second charge transport layer is T2(%), a relationship of $\{0 \leq (T1-T2) \leq 4\}$ is satisfied, and the first charge transport layer contains a charge transport material α having a molecular weight of 600 or more.

[2] The electrophotographic photoreceptor according to item [1], wherein the T1 is 44% to 49%.

[3] The electrophotographic photoreceptor according to item [1] or [2], wherein the T2 is 43% to 47%.

[4] The electrophotographic photoreceptor according to any one of items [1] to [3], wherein the second charge transport layer contains a charge transport material 3.

[5] The electrophotographic photoreceptor according to item [4], wherein at least one of the charge transport materials β is a charge transport material γ having a molecular weight of 600 or more.

[6] The electrophotographic photoreceptor according to any one of items [1] to [5], wherein a content of the charge transport material α relative to 100 parts by mass of the binder resin A in the first charge transport layer is 10 parts by mass to 40 parts by mass.

[7] The electrophotographic photoreceptor according to any one of items [4] to [6], wherein the content of the charge transport material α relative to 100 parts by mass of the binder resin A in the first charge transport layer is equal to or less than a content of the charge transport material β relative to 100 parts by mass of the binder resin B in the second charge transport layer.

[8] The electrophotographic photoreceptor according to any one of items [1] to [7], wherein the binder resin A and the binder resin B have different monomer units from each other.

[9] The electrophotographic photoreceptor according to any one of items [1] to [8], wherein the binder resin A is a polyarylate resin and the binder resin B is a polycarbonate resin.

[10] An electrophotographic photoreceptor cartridge, comprising:

the electrophotographic photoreceptor according to any one of items [1] to [9]; and at least one device selected from the group consisting of a charging device which charges the electrophotographic photoreceptor, an exposure device which exposes the charged electrophotographic photoreceptor to form an electrostatic latent image, a developing device which develops the electrostatic latent image formed on the electrophotographic photoreceptor, a transfer device which transfers a developed toner, a cleaning device which cleans the remaining toner on the electrophotographic photoreceptor, and a fixing device which fixes the transferred toner onto a print medium.

[11] An image forming apparatus comprising: the electrophotographic photoreceptor according to any one of items [1] to [9]; a charging device which charges the electrophotographic photoreceptor; an exposure device which exposes the charged electrophotographic photoreceptor to form an electrostatic latent image; and a developing device which develops the electrostatic latent image formed on the electrophotographic photoreceptor.

Advantageous Effects of Invention

According to the present invention, an electrophotographic photoreceptor having sufficient abrasion resistance indispensable for long life use and excellent in electrical properties and adhesiveness, an electrophotographic photoreceptor cartridge and an image forming apparatus can be provided.

DESCRIPTION OF EMBODIMENTS

Figure 1:
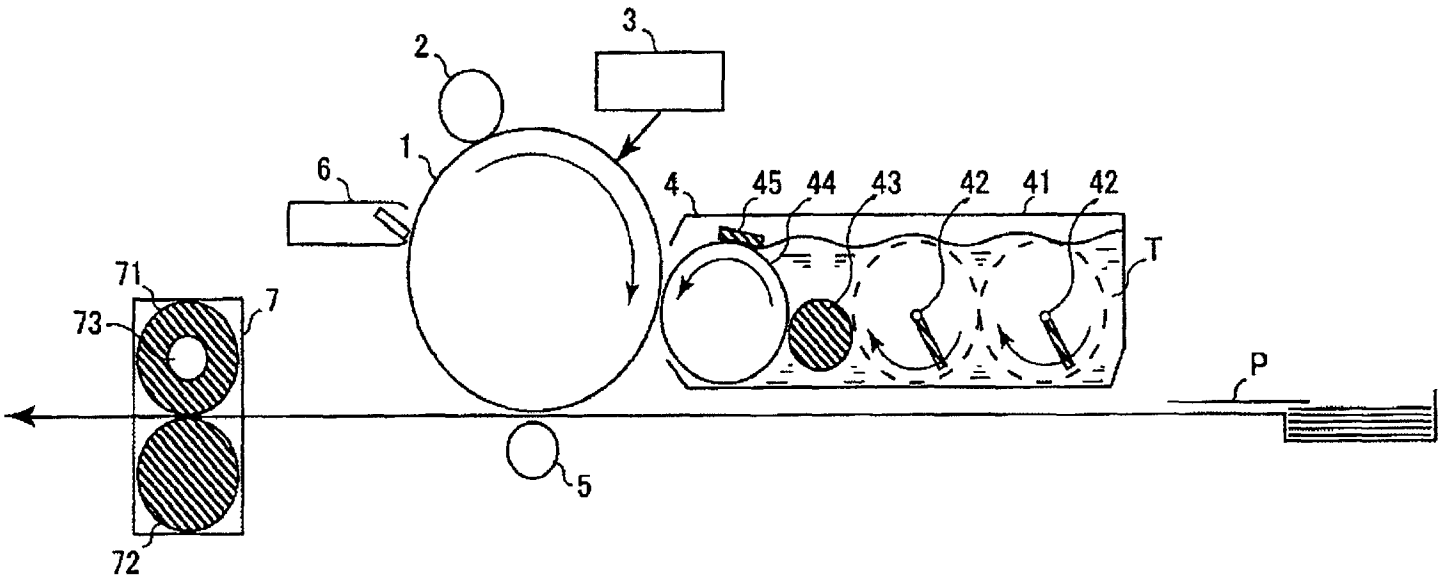
FIG. 1 is a schematic diagram showing a configuration of a main part of one embodiment of an image forming apparatus of the present invention.

Hereinafter, embodiments of the present invention will be described in detail, but the description of the constituent features described below are representative examples of the embodiments of the present invention, and can be appropriately modified and implemented without departing from the spirit of the present invention. In the description, "% by mass" and "part by mass", and '% by weight' and 'part by weight' are synonymous with each other, and in the case of 'part', it means 'part by weight'.

<<Electrophotographic Photoreceptor>>

Hereinafter, the configuration of the electrophotographic photoreceptor according to the present invention is described.

The electrophotographic photoreceptor according to the present invention includes a conductive support and has a lamination type configuration having at least a charge generation layer and a charge transport layer in this order on the conductive support. An undercoat layer may be provided between the conductive support and the charge generation layer, if necessary.

<Conductive Support>

Although the conductive support is not particularly limited, mainly used as the conductive support is, for example, a metallic material such as aluminum, an aluminum alloy, stainless steel, copper, or nickel, a resin material to which conductivity has been imparted by adding a conductive powder, such as a metal, carbon, or tin oxide powder, or a resin, glass, paper, or the like, having a surface on which a conductive material, e.g., aluminum, nickel, or ITO (indium oxide/tin oxide) has been vapor deposited or coated. One selected from these may be used alone, or two or more selected from these may be used in any desired combination and in any desired proportion.

As a form of the conductive support, a drum-like conductive support, a sheet-like conductive support, a belt-like conductive support, or the like can be used. Further, on the conductive support made of a metal material, a conductive material having an appropriate resistance value may be applied for control of conductivity, surface property and the like and coating of defects.

In a case where a metallic material such as an aluminum alloy is used as a conductive support, this material may be used after an anodized layer is formed thereon. In the case where an anodized layer has been formed, the material is preferably subjected to a pore-sealing treatment by a known method.

The surface of the support may be smooth, or it may be roughened by applying a special cutting method or a polishing treatment. It may also be roughened by mixing particles having an appropriate particle diameter with a material constituting the support. In addition, in order to reduce the cost, it is also possible to use a drawn pipe as it is without performing the cutting treatment.

<Undercoat Layer>

In order to improve the adhesiveness, the blocking property and the like, an undercoat layer (sometimes also referred to as a blocking layer, a conductive layer or an intermediate layer depending on the function thereof) may be provided between the conductive support and the charge generation layer described below. As the undercoat layer, a resin or a resin in which particles of a metal oxide or the like is dispersed is used. In addition, the undercoat layer may include a single layer, or may include a plurality of layers.

Examples of the particles of metal oxide used for the undercoat layer include particles of a metal oxide containing one metallic element, such as titanium oxide, aluminum oxide, silicon oxide, zirconium oxide, zinc oxide, and iron oxide, and particles of a metal oxide containing a plurality of metallic elements, such as calcium titanate, strontium titanate, and barium titanate. One kind of those particles may be used alone, or two or more kinds of those particles may be mixed together and used. Preferred of these particles of metal oxide are particles of titanium oxide and/or aluminum oxide. Particularly preferred are particles of titanium oxide.

The surface of the titanium oxide particle may be treated with inorganic materials such as tin oxide, aluminum oxide, antimony oxide, zirconium oxide, silicon oxide, or organic materials such as stearic acid, polyol, and silicon. As the crystal form of the titanium oxide particles, any of rutile, anatase, brookite, and amorphous can be used. Further, a plurality of crystalline states may be included.

Although particles of metal oxide having various particle diameters can be utilized, from the standpoints of properties thereof and liquid stability, preferably used of those particles are particles of metal oxide having an average primary-particle diameter of 10 nm to 100 nm, and particularly preferably 10 nm to 50 nm. The average primary-particle diameter can be obtained from a TEM photograph.

The undercoat layer is preferably formed so as to contain a binder resin and metal oxide particles dispersed therein. Examples of the binder resin to be used in the undercoat layer include: an epoxy resin, a polyethylene resin, a polypropylene resin, an acrylic resin, a methacrylic resin, a polyamide resin, a vinyl chloride resin, a vinyl acetate resin, a phenol resin, a polycarbonate resin, a polyurethane resin, a polyimide resin, a vinylidene chloride resin, a polyvinyl acetal resin, a vinyl chloride-vinyl acetate copolymer, a polyvinyl alcohol resin, a polyurethane resin, a polyacrylic resin, a polyacrylamide resin, a polyvinylpyrrolidone resin, a polyvinylpyridine resin, a water-soluble polyester resin, a cellulose ester resin such as nitrocellulose, a cellulose ether resin, a casein, a gelatin, a polyglutamic acid, starch, starch acetate, amino starch, organic zirconium compounds such as zirconium chelate compounds and zirconium alkoxide compounds, organic titanyl compounds such as titanyl chelate compounds and titanium alkoxide compounds, a silane coupling agent or the like, which are known binder resins. One selected from these may be used alone, or two or more selected from these may be used in any desired combination and in a desired proportion. In addition, these resins may be used together with a curing agent to come into a hardened state. Among them, alcohol-soluble copolymerized polyamides, modified polyamides, and the like are preferred because of the excellent dispersibility and coating properties they exhibit.

Although the ratio of inorganic particles to be used in the undercoat layer with respect to the binder resin can be selected at will, the ratio is preferably in a range of 10% by mass to 500% by mass with respect to the binder resin, from the viewpoints of the stability and applicability of the dispersion.

Although the thickness of the undercoat layer can be optionally selected without impairing the effects of the present invention remarkably, the thickness is usually 0.01 μm or more, and preferably 0.1 μm or more, and usually 30 μm or less and preferably 20 μm or less, from the standpoints of improving the electrical properties, the strong exposure property, the image properties and the repetition property of the electrophotographic photoreceptor, and of improving the applicability during production.

A known antioxidant and the like may be incorporated into the undercoat layer. In addition, in order to prevent image defects or the like, pigment particles, resin particles or the like may be contained and used.

<Charge Generation Layer>

The charge generation layer contains a charge generation material and usually contains a binder resin and other components which are used if necessary. Such a charge generation layer can be obtained, for example, by dissolving or dispersing a charge generation material and a binder resin in a solvent or a dispersion medium to prepare a coating liquid, coating the coating liquid on a conductive support (on an undercoat layer in the case of providing the undercoat layer) and drying the above.

Examples of the charge generation substance include inorganic photoconductive materials, such as selenium, and alloys thereof, and cadmium sulfide, and organic photoconductive materials such as organic pigments. Preferred of these are organic photoconductive materials, and particularly preferred are organic pigments. Examples of the organic pigments include phthalocyanine pigments, azo pigments, dithioketopyrrolopyrrole pigments, squalene (squarylium) pigments, quinacridone pigments, indigo pigments, perylene pigments, polycyclic quinone pigments, anthanthrone pigments, and benzimidazole pigments. Particularly preferred of those organic pigments are phthalocyanine pigments and azo pigments. In the case of using any of these organic pigments as the charge generation substance, the organic pigment is used generally in the form of a dispersion layer in which fine particles thereof have been bound with any of various binder resins.

In a case where a phthalocyanine pigment is used as the charge generation substance, specific examples thereof include metal-free phthalocyanine, metal such as copper, indium, gallium, tin, titanium, zinc, vanadium, silicon, germanium, and aluminum, those having crystal forms of coordinated phthalocyanines such as halides, hydroxides, and alkoxides, and phthalocyanine dimers using an oxygen atom or the like as a bridge atom. Particularly, an X form with high sensitivity, a τ-form metal-free phthalocyanine, titanyl phthalocyanines (alternative name: oxytitanium phthalocyanine) such as A form (also known as a β form), a B form (also known as an α form), or a D form (also known as a Y form), vanadyl phthalocyanine, chloroindium phthalocyanine, hydroxy indium phthalocyanine, II-form chlorogallium phthalocyanine, V-form hydroxygallium phthalocyanine, O-form or I-form μ-oxo-gallium phthalocyanine dimer, or II-form μ-oxo-aluminum phthalocyanine dimer is preferable.

Particularly preferred of these phthalocyanines are A-form (also called β-form) and B-form (also called α-form) titanyl phthalocyanines, D-form (Y-form) titanyl phthalocyanine characterized by showing a distinct peak at a diffraction angle 2θ(±0.2°) of 27.1° or 27.3° in X-ray powder diffractometry, II-form chlorogallium phthalocyanine, V-form hydroxygallium phthalocyanine, hydroxygallium phthalocyanine having a strongest peak at 28.1°, or hydroxygallium phthalocyanine characterized by having no peak at 26.2°, having a clear peak at 28.1° and a half-value width W at 25.9° of 0.1°≤W≤0.4°, and a G-form μ-oxo-gallium phthalocyanine dimer.

A single phthalocyanine compound may be used alone, or a mixture of some phthalocyanine compounds or a mixture of some crystal states may be used. This mixed state of phthalocyanine compounds or of crystal states to be used here may be a mixture obtained by mixing the components prepared beforehand, or may be a mixture which came into the mixed state during phthalocyanine compound production/treatment steps such as synthesis, pigment formation, and crystallization. Known as such treatment steps include an acid paste treatment, grinding, solvent treatment, and the like. Examples of methods for obtaining a mixed-crystal state include a method in which two kinds of crystals are mixed, subsequently mechanically ground to render the crystals amorphous, and then subjected to a solvent treatment to convert into specific crystal states, as described in JP-A-10-48859.

In the case of using an azo pigment as a charge generation material, various conventionally known azo pigments can be used as long as they have sensitivity to light source for light input, but various bisazo pigments and trisazo pigments are suitably used.

In the case of using the above organic pigment as the charge generation substance, one of these pigments may be used alone, or two or more of the pigments may be mixed and used. In this case, it is preferable to use two or more of charge generation substances having spectral sensitivity characteristics in different spectral regions of the visible region and the near-red region in combination, and among them, it is more preferable to use a disazo pigment, a trisazo pigment and a phthalocyanine pigment in combination.

The binder resin used for the charge generation layer is not particularly limited. Examples thereof include insulating resins such as a polyvinyl acetal resin, for example, a polyvinyl butyral resin, a polyvinyl formal resin, and a partly acetalized polyvinyl butyral resin in which the butyral moieties have been partly modified with formal, acetal, or the like, a polyarylate resin, a polycarbonate resin, a polyester resin, a modified ether-type polyester resin, a phenoxy resin, a polyvinyl chloride resin, a polyvinylidene chloride resins, a polyvinyl acetate resin, a polystyrene resin, an acrylic resin, a methacrylic resin, a polyacrylamide resin, a polyamide resin, a polyvinylpyridine resin, a cellulosic resin, a polyurethane resin, an epoxy resin, a silicon resin, a polyvinyl alcohol resin, a polyvinylpyrrolidone resin, casein, copolymers based on vinyl chloride and vinyl acetate, for example, vinyl chloride/vinyl acetate copolymers, hydroxy-modified vinyl chloride/vinyl acetate copolymers, carboxyl-modified vinyl chloride/vinyl acetate copolymers, and vinyl chloride/vinyl acetate/maleic anhydride copolymers, styrene/butadiene copolymers, vinylidene chloride/acrylonitrile copolymers, styrene-alkyd resins, silicon-alkyd resins, and phenol-formaldehyde resins; and organic photoconductive polymers such as poly-N-vinylcarbazole, polyvinylanthracene, and polyvinylperylene. Any one of these binder resins may be used alone, or any desired combination of two or more thereof may be mixed and used.

Specifically, the charge generation layer is formed by dispersing a charge generation substance in a solution of the above binder resin being dissolved in an organic solvent to prepare a coating liquid, and coating the coating liquid on a conductive support (on an undercoat layer in the case of providing the undercoat layer).

In the charge generation layer, regarding the mixing ratio (the mass ratio) of the charge generation substance to the binder resin, the charge generation substance is generally 10 parts by mass or more, and preferably 30 parts by mass or more, and is generally 1,000 parts by mass or less, and preferably 500 parts by mass or less, based on 100 parts by mass of the binder resin. When the ratio of the charge generation substance is excessively high, the stability of the coating liquid may be deteriorated due to aggregation of the charge generation substance or the like. When the ratio of the charge generation substance is excessively low, the sensitivity of the photoreceptor may be lowered.

The thickness of the charge generation layer is generally in a range of 0.1 μm or more, preferably 0.15 μm or more, and is generally 10 μm or less, and preferably 0.6 μm or less.

Known dispersion methods such as a ball mill dispersion method, an attritor dispersion method and a sand mill dispersion method can be used as a method of dispersing the charge generation substance. At this time, it is effective to pulverize the particles to a particle size of 0.5 μm or less, preferably 0.3 μm or less, and more preferably 0.15 μm or less.

<Charge Transport Layer>

The charge transport layer according to the present invention has at least two layers. Hereinafter, numbers are assigned from the outermost charge transport layer, the outermost charge transport layer is taken as a first charge transport layer, and the charge transport layer in contact with the first charge transport layer is taken as a second charge transport layer. In the case of three charge transport layers, the charge transport layer on the charge generation layer side and in contact with the second charge transport layer is taken as a third charge transport layer.

The number of the layers in the charge transport layer is not particularly limited, and is usually 10 layers or less, preferably 5 layers or less, more preferably 3 layers or less, and most preferably 2 layers.

The first charge transport layer contains a charge transport material α having a molecular weight of 600 or more and a binder resin, and other components used if necessary. The second and subsequent charge transport layers contain a binder resin. From the viewpoint of charge transporting property, the second and subsequent charge transport layers preferably contain a charge transport material.

The binder resin contained in the first charge transport layer is referred to as a binder resin A, and the binder resin contained in the second charge transport layer is referred to as a binder resin B.

Figure 2:
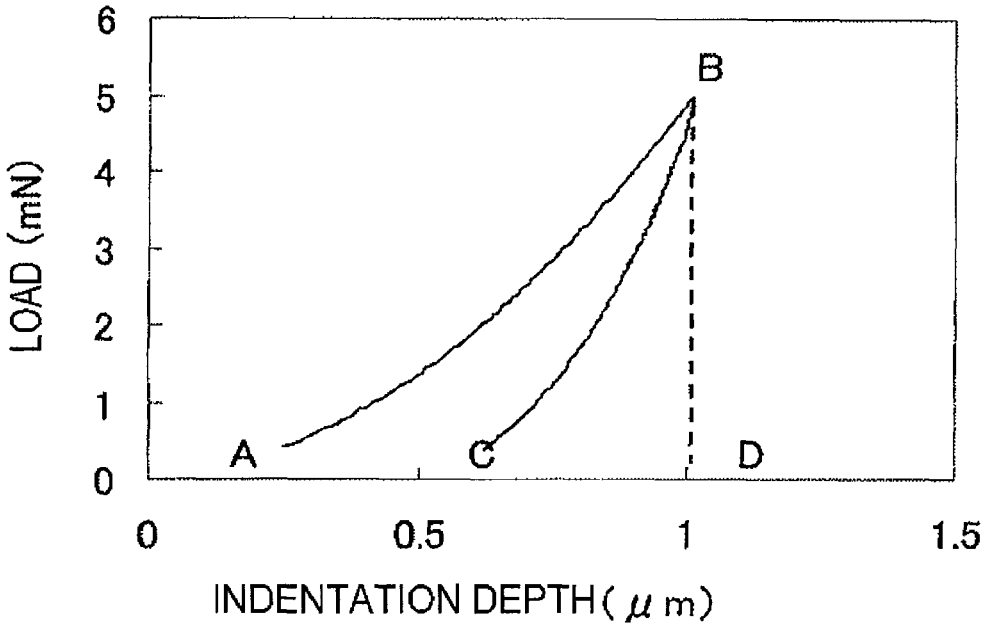
FIG. 2 is a graph showing a load curve with respect to an indentation depth in measurement of an elastic deformation ratio of a binder resin, and shows a method for calculating an elastic deformation ratio.

The elastic deformation ratio of the binder resin contained in the charge transport layer is measured using a micro hardness tester FISCHERSCOPE HM2000 manufactured by Fischer Co., Ltd. (a micro hardness tester FISCHERSCOPE H100C successor manufactured by the same company, having the same performance) under an environment with a temperature of 25° C. and a relative humidity of 50%. For the measurement, a Vickers square pyramid diamond indenter having a facing angle of 136° is used. The measurement is performed under the following conditions, a load applied to the indenter and an indentation depth under the load is continuously read, and the road and the indentation depth are respectively plotted as Y axis (load) and X axis (indentation depth) as shown in FIG. 2.

Measurement Conditions

Maximum indentation load: 5 mN

Loading time required: 10 seconds

Unloading time required: 10 seconds

The above elastic deformation ratio is a value defined by the following equation and is the ratio of the workload performed by elasticity of the film at the time of unloading, with respect to the total workload required for pushing.

$$\text{Elastic deformation ratio (\%)}=(We/Wt)\times 100$$

In the above equation, Wt (nJ) represents the total workload and indicates the area surrounded by A-B-D-A in FIG. 2. We (nJ) represents the elastic deformation workload, and indicates the area surrounded by C-B-D-C in FIG. 2.

As the elastic deformation ratio increases, deformation against the load hardly remains, and when the elastic deformation ratio is 100%, deformation does not remain. Under the above measurement conditions, the indentation depth at the time of measurement of this application is approximately 1 μm.

In the present invention, for the elastic deformation ratio of the binder resin, the measured value for a thin film similar to the charge transport layer described below is used rather than a thin film of binder resin alone. That is, a coating liquid obtained by dissolving 100 parts by mass of a binder resin, 40 parts by mass of a charge transport material represented by the following Formula (1), and 0.05 part by mass of a silicone oil (manufactured by Shin-Etsu Silicone Co., Ltd., trade name KF96), in tetrahydrofuran/toluene (8/2 (mass ratio)) is coated on a glass substrate and dried, such that the film thickness after drying is 20 μm, to prepare a measurement sample. The sample is measured with the measuring machine described above, and the value of the elastic deformation ratio obtained is taken as the elastic deformation ratio of the binder resin.

FORMULA (1)

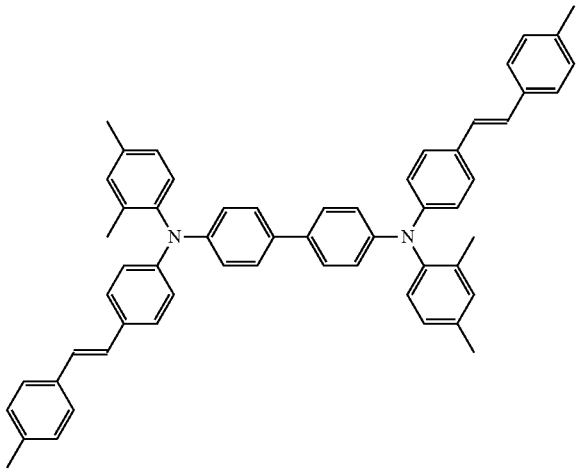

In the electrophotographic photoreceptor according to the present invention, when the elastic deformation ratio of the binder resin A contained in the first charge transport layer is T1(%) and the elastic deformation ratio of the binder resin B contained in the second charge transport layer is T2(%), a relationship of $\{0\leq(T1-T2)\leq 4\}$ is satisfied. It is preferable that a relationship of $\{0\leq(T1-T2)\leq 3\}$ is satisfied from the viewpoint of balance between adhesiveness and abrasion resistance, and it is more preferable that a relationship of $\{0\leq(T1-T2)\leq 2\}$ is satisfied from the viewpoint of maximizing the effect of abrasion resistance. When the above range is reached, the abrasion resistance of the first charge transport layer is not impaired by the second charge transport layer and adhesiveness can also be ensured.

The value of T1 is not particularly limited, and is preferably 44% or more, more preferably 45% or more and still more preferably 46% or more from the viewpoint of abrasion resistance; and is preferably 49% or less, and more preferably 48% or less from the viewpoint of adhesiveness.

In addition, the value of T2 is not particularly limited, and is preferably 43% or more, and more preferably 44% or more from the viewpoint of abrasion resistance; and is preferably 47% or less, and more preferably 46% or less from the viewpoint of adhesiveness.

As specific examples of the binder resin A and the binder resin B, a butadiene resin, a styrene resin, a vinyl acetate resin, a vinyl chloride resin, an acrylate resin, a methacrylate resin, a vinyl alcohol resin, polymers and copolymers of vinyl compounds such as ethyl vinyl ether, a polyvinyl butyral resin, a polyvinyl formal resin, a partially modified polyvinyl acetal, a polyamide resin, a polyurethane resin, a cellulose ester resin, a phenoxy resin, a silicone resin, a silicone-alkyd resin, a poly-N-vinyl carbazole resin, a polycarbonate resin, and a polyester resin are suitably used. Among them, a polycarbonate resin and a polyester resin are preferred.

A polyarylate resin, which is a name for a wholly aromatic polyester resin, among the polyester resins can increase the elastic deformation ratio and is particularly preferred from the viewpoint of mechanical properties such as abrasion resistance, scratch resistance, and filming resistance.

Generally, the polyester resin is superior to a polycarbonate resin from the viewpoint of mechanical properties, but is inferior to the polycarbonate resin from the viewpoint of electrical properties and light fatigue properties. This is believed to be due to the fact that the ester bond has larger polarity and has stronger acceptor property than the carbonate bond.

Two or more of these resins may be mixed and used within the range not to impair their functions. In the case of mixing two or more binder resins, the binder resin within the above preferred elastic deformation ratio preferably has a content ratio of 50% or more, more preferably 70% or more, and most preferably 90% or more.

First, the polyester resin will be described below. Generally, the polyester resin is obtained by polycondensing a polyhydric alcohol component and a polyvalent carboxylic acid component such as a carboxylic acid, a carboxylic acid anhydride, and a carboxylic acid ester, as raw material monomers.

Examples of the polyhydric alcohol component include an alkylene (C2-3) oxide adduct of bisphenol A (average addition molar number of 1 to 10) such as olyoxypropylene (2.2)-2,2-bis(4-hydroxyphenyl) propane and polyoxyethylene(2.2)-2,2-bis(4-hydroxyphenyl) propane, ethylene glycol, propylene glycol, neopentyl glycol, glycerin, pentaerythritol, trimethylolpropane, hydrogenated bisphenol A, sorbitol, or an alkylene (C2-3) oxide adduct (average addition molar number of 1 to 10) thereof, and an aromatic bisphenol. One containing one or more of these is preferred.

Examples of the polyvalent carboxylic acid component include dicarboxylic acid such as phthalic acid, isophthalic acid, terephthalic acid, fumaric acid and maleic acid; succinic acid substituted with an alkyl group having 1 to 20 carbon atoms or an alkenyl group having 2 to 20 carbon atoms such as dodecenylsuccinic acid and octylsuccinic acid; trimellitic acid, pyromellitic acid, and anhydrides of these acids and alkyl (C1-3) esters of these acids. One containing one or more of these is preferred.

Among these polyester resins, preferred is a wholly aromatic polyester resin (polyarylate resin) having a structural unit represented by the following Formula (2).

FORMULA (2)

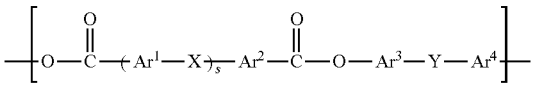

In Formula (2), $Ar^1$ to $Ar^4$ each independently represent an arylene group which may have a substituent, and X represents a single bond, an oxygen atom, a sulfur atom or an alkylene group. s represents an integer of 0 to 2. Y represents a single bond, an oxygen atom, a sulfur atom, or an alkylene group.

The number of carbon atoms of the arylene group represented by $Ar^1$ to $Ar^4$ is usually 6 or more, and is usually 20 or less, preferably 10 or less, and more preferably 6. In a case where the number of carbon atoms is too large, the production cost increases and the electrical properties may deteriorate.

Specific examples of $Ar^1$ to $Ar^4$ include a 1,2-phenylene group, a 1,3-phenylene group, a 1,4-phenylene group, a naphthylene group, an anthrylene group, a phenanthrylene group, or the like. From the standpoint of electrical properties, as an arylene group, preferred is a 1,4-phenylene group. One selected from the arylene group may be used alone, or two or more selected from the arylene group may be used in any desired proportion and in any desired combination.

Examples of a substituent that $Ar^1$ to $Ar^4$ may have include an alkyl group, an aryl group, a halogen atom, an alkoxy group, or the like. Among these, considering the mechanical properties as the binder resin for the charge transport layer and the solubility in a charge transport layer forming coating liquid, the alkyl group is preferably a methyl group, an ethyl group, a propyl group, or an isopropyl group, the aryl group is preferably a phenyl group or a naphthyl group, the halogen atom is preferably a fluorine atom, a chlorine atom, a bromine atom, or an iodine atom, and the alkoxy group is preferably a methoxy group, an ethoxy group, a propoxy group or a butoxy group. In a case where the substituent is an alkyl group, the number of carbon atoms of the alkyl group is usually 1 or more, and is usually 10 or less, preferably 8 or less, and more preferably 2 or less.

In more detail, it is preferable that $Ar^3$ and $Ar^4$ each independently have the number of substituents of 0 to 2, and it is preferable to have a substituent from the standpoint of adhesiveness. Among these, from the standpoint of abrasion resistance, it is particularly preferable to have the number of substituents of 1. As a substituent, preferred is an alkyl group, and particularly preferred is a methyl group.

It is preferable that $Ar^1$ and $Ar^2$ each independently have the number of substituents of 0 to 2, and from the standpoint of abrasion resistance, it is preferable that $Ar^1$ and $Ar^2$ have no substituent.

In the above Formula (2), Y is a single bond, an oxygen atom, a sulfur atom, or an alkylene group. The alkylene group is preferably $—CH_2—$, $—CH(CH_3)—$, $—C(CH_3)_2—$, and cyclohexylene, more preferably $—CH_2—$, $—CH(CH_3)—$, $—C(CH_3)_2—$, and 1,4-cyclohexylene, and particularly preferably $—CH_2—$ and $—CH(CH_3)—$.

In the above Formula (2), X is a single bond, an oxygen atom, a sulfur atom, or an alkylene group. Among these, X is preferably an oxygen atom. At this time, s is particularly preferably 1.

In a case where s is 1, specific examples of a preferable dicarboxylic acid residue include a diphenyl ether-2,2'-dicarboxylic acid residue, a diphenyl ether-2,3'-dicarboxylic acid residue, a diphenyl ether-2,4'-dicarboxylic acid residue, a diphenyl ether-3,3'-dicarboxylic acid residue, a diphenyl ether-3,4'-dicarboxylic acid residue, a diphenyl ether-4,4'-dicarboxylic acid residue, or the like. Considering convenience in production the dicarboxylic acid component, among these, more preferred are a diphenyl ether-2,2'-dicarboxylic acid residue, a diphenyl ether-2,4'-dicarboxylic acid residue, and a diphenyl ether-4,4'-dicarboxylic acid residue, and particularly preferred is a diphenyl ether-4,4'-dicarboxylic acid residue.

In a case where s is 0, specific examples of the dicarboxylic acid residue include a phthalic acid residue, an isophthalic acid residue, a terephthalic acid residue, a toluene-2,5-dicarboxylic acid residue, a p-xylene-2,5-dicarboxylic acid residue, a naphthalene-1,4-dicarboxylic acid residue, a naphthalene-2,3-dicarboxylic acid residue, a naphthalene-2,6-dicarboxylic acid residue, a biphenyl-2,2'-dicarboxylic acid residue, and biphenyl-4,4'-dicarboxylic acid residue. Preferred are a phthalic acid residue, an isophthalic acid residue, a terephthalic acid residue, a naphthalene-1,4-dicarboxylic acid residue, a naphthalene-2,6-dicarboxylic acid residue, a biphenyl-2,2'-dicarboxylic acid residue, and a biphenyl-4,4'-dicarboxylic acid residue, and particularly preferred are an isophthalic acid residue and a terephthalic acid residue. A combination of a plurality of these dicarboxylic acid residues can also be used.

In the case of using an isophthalic acid residue and a terephthalic acid residue in combination, the ratio of the isophthalic acid residue to the terephthalic acid residue is usually 50:50, but it can be changed arbitrarily. In this case, it is preferable that the ratio of the terephthalic acid residue is as high as possible from the viewpoint of the electrical properties.

The viscosity-average molecular weight of the polyester resin used in the present invention is arbitrary as long as the effect of the present invention is not significantly impaired, and is preferably 20,000 or more, more preferably 30,000 or more, and the upper limit thereof is preferably 80,000 or less, and more preferably 70,000 or less. In a case where the value of viscosity-average molecular weight is too small, the mechanical strength of the polyester resin may be insufficient; in a case where the viscosity-average molecular weight is too large, the viscosity of the coating liquid for forming the charge generation layer or the charge transport layer is too high and the productivity may be lowered. The viscosity-average molecular weight can be measured by the method described in the examples, for example, using an Ubbelohde capillary viscometer or the like.

Next, the polycarbonate resin will be described below. The polycarbonate resin is produced by a solvent method such as an interfacial method (interfacial polycondensation method) or a solution method in which bisphenols and phosgene are reacted in a solution, and is known to be obtained by a melting method in which a bisphenol and a carbonic acid diester are subjected to a polycondensation reaction by a transesterification reaction.

Among these, the polycarbonate resin produced by the interfacial method is widely used for the electrophotographic photoreceptor since they can be made to have a high molecular weight, purified by liquid-liquid washing and applicable to various kinds of bisphenols. In the interfacial method, phosgene is used as a raw material, therefore safety is concerned. The type of bisphenol that can be polymerized in the polycarbonate resin by the melting method is limited and it is difficult to increase the molecular weight and also difficult to remove the impurities by washing in the melting method. On the contrary, since phosgene is not used in the polymerization step, the melting method has merit in terms of safety, and the use thereof is also studied for use in electrophotographic photoreceptors.

One or a mixture of two or more known polycarbonate resins obtained by copolymerizing two or more kinds of known bisphenols can be used in the electrophotographic photoreceptor according to the present invention. Among the known bisphenols, a polycarbonate resin containing a structural unit represented by the following Formula (3) is suitably used from the viewpoints of electrical properties, surface hardness, elastic deformation ratio and adhesiveness.

FORMULA (3)

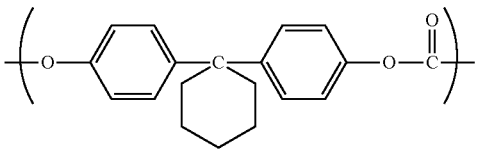

The polycarbonate resin used in the present invention may be a homopolymer including a single unit represented by the above Formula (3), and may also be copolymerized with other bisphenol units to be a block or random copolymer. Examples of bisphenol units which may be copolymerized are shown as follows. For the copolymerization ratio, the proportion of the above Formula (3) is preferably 50% by mass or more, and more preferably 60%/o by mass or more.

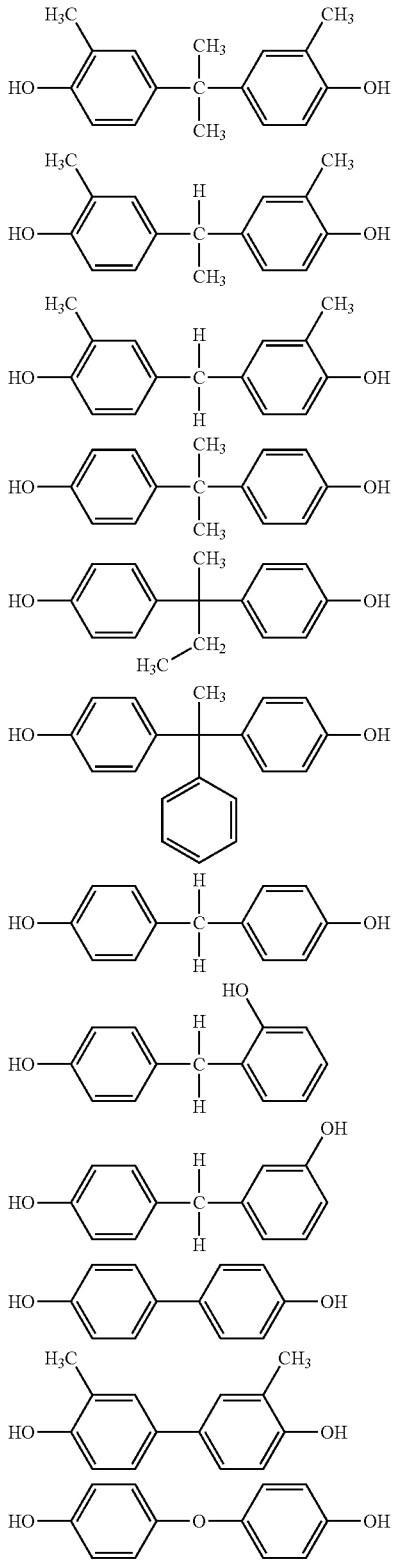

-continued

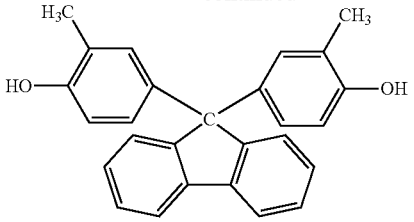

The preferred range of the viscosity-average molecular weight of the polycarbonate resin used in the present invention is the same as in the case of the polyester resin.

The binder resin contained in the charge transport layer of the present invention is not particularly limited as long as both of the binder resin A and the binder resin B have the elastic deformation ratio within the above range. From the viewpoints of electrical properties, abrasion resistance, filming resistance and adhesiveness, it is preferable that the binder resin A of the first charge transport layer and the binder resin B of the second charge transport layer have different monomer units from each other. From the viewpoint of compatibility of electrical properties, abrasion resistance and adhesiveness, the binder resin A of the first charge transport layer is more preferably a polyarylate resin. From the viewpoint of compatibility of electrical properties, abrasion resistance and adhesiveness, the binder resin B of the second charge transport layer is more preferably a polycarbonate resin.

The type of the charge transport material is not particularly limited, and is preferably a carbazole derivative, a hydrazone compound, an aromatic amine derivative, an enamine derivative, a butadiene derivative, and a derivative thereof. Any one of these charge transport materials may be used alone, or any desired combination of two or more thereof may be used.

The molecular weight of the charge transport material α used in the first charge transport layer is 600 or more. Preferred is 680 or more, more preferred is 720 or more, and still more preferred is 750 or more. From the viewpoint of solubility and abrasion resistance, the molecular weight is usually 1000 or less. The molecular weight within the above range is preferred from the viewpoint of easily exhibiting the desired electrical properties with a small amount and hardly reducing the elastic deformation ratio of the charge transport layer.

The second and subsequent charge transport layers preferably contain a charge transport material. For example, it is preferable that the second charge transport layer contains a charge transport material β.

In the case of containing the charge transport material, the molecular weight of the charge transport material is not particularly limited, and is usually 300 or more, preferably 400 or more, more preferably 500 or more, still more preferably 600 or more, even more preferably 680 or more, particularly preferably 720 or more, and most preferably 750 or more. From the viewpoint of solubility and abrasion resistance, the molecular weight is usually 1000 or less. The molecular weight within the above range is preferred from the viewpoint of easily exhibiting the desired electrical properties with a small amount and hardly reducing the elastic deformation ratio of the charge transport layer. For example, it is more preferable that at least one of the charge transport material β contained in the second charge transport layer is a charge transport material γ having a molecular weight of 600 or more.

The molecular weight of the charge transport material α contained in the first charge transport layer is preferably equal to or larger than the molecular weight of the charge transport material β contained in the second charge transport layer. When such a condition is satisfied, it is advantageous from the viewpoint of balance between abrasion resistance and electrical properties while suppressing the cost.

Examples of preferred charge transport materials contained in the first charge transport layer and the second and subsequent charge transport layers are shown in Table 1. In Table 1, Me represents a methyl group and Et represents an ethyl group.

TABLE 1

| No. | Structural formula | Molecular weight |
|---|---|---|
| CT-1 | 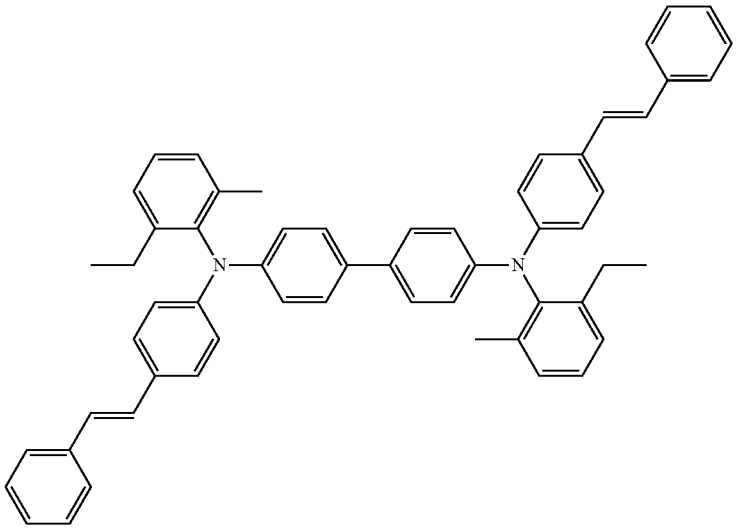 | 771.1 |

TABLE 1-continued
| No. | Structural formula | Molecular weight |
|---|---|---|
| CT-2 | 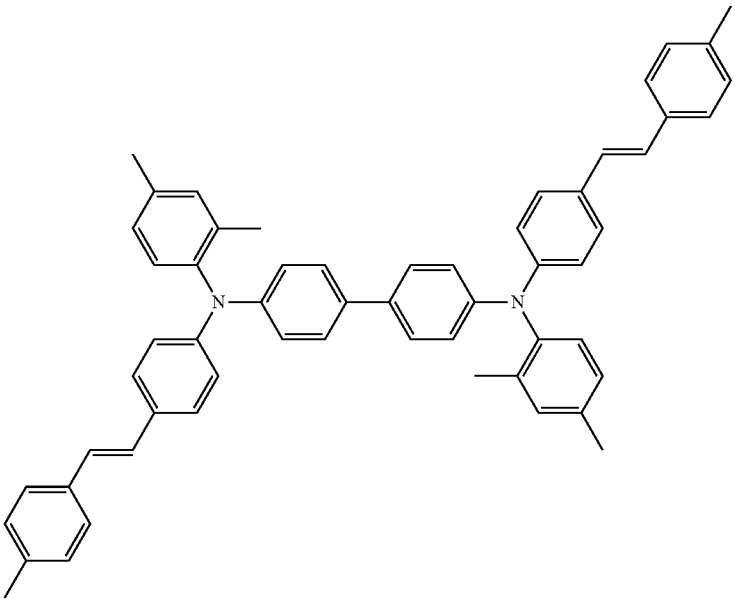 | 771.1 |
| CT-3 | 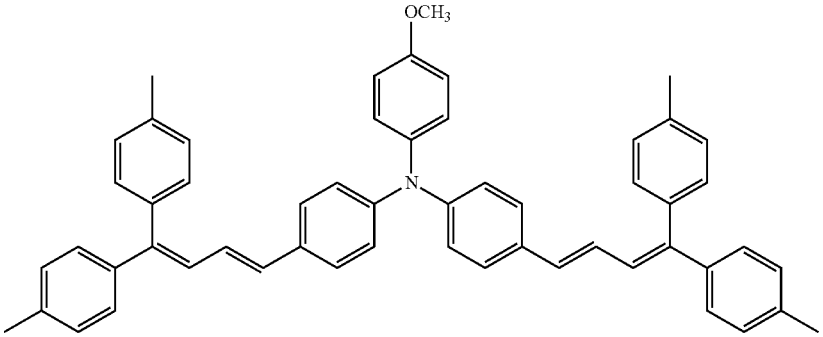 | 740.4 |
| CT-4 | 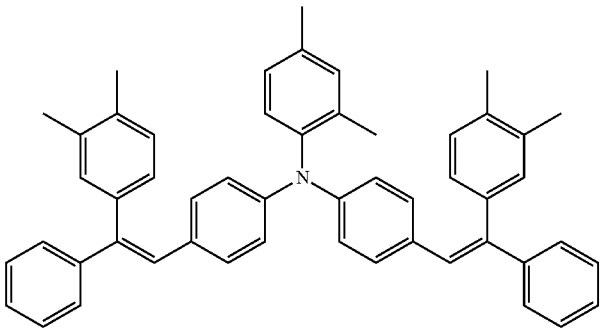 | 686.0 |
| CT-5 | 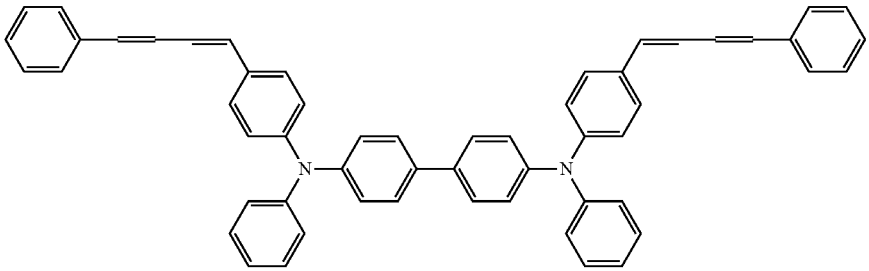 | 745.0 |

TABLE 2
| No. | Structural formula | Molecular weight |
|---|---|---|
| CT-6 | 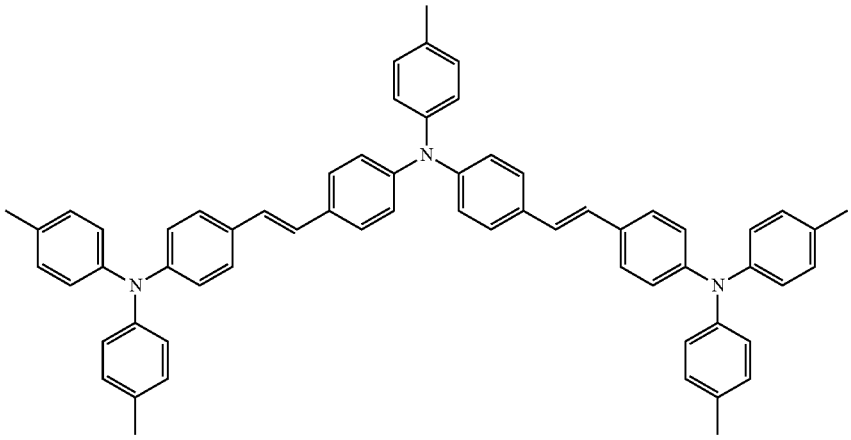 | 854.1 |
| CT-7 | 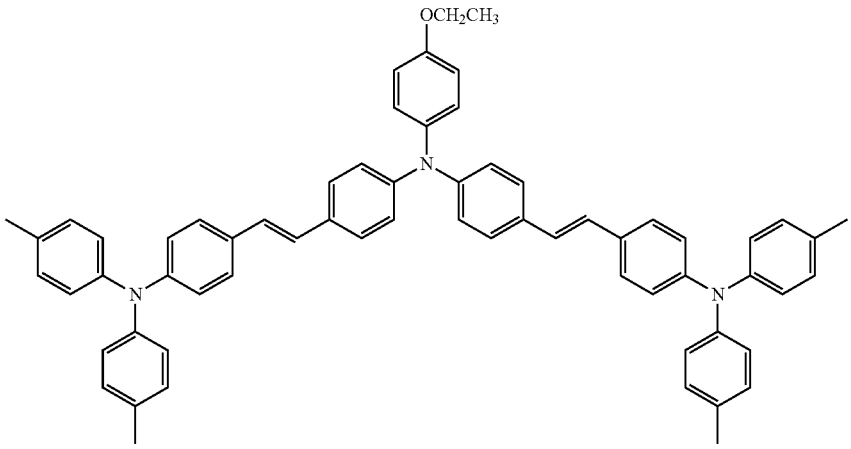 | 884.2 |
| CT-8 | 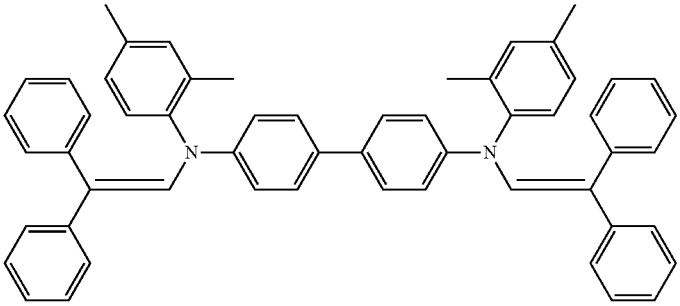 | 749.0 |

TABLE 2-continued

| No. | Structural formula | Molecular weight |
|---|---|---|
| CT-9 | 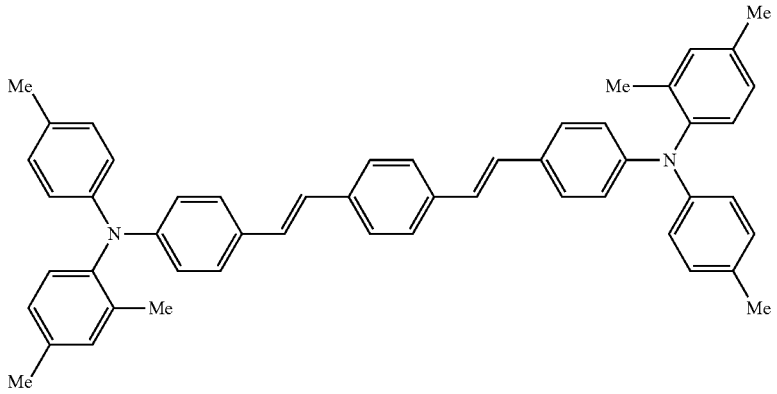 | 701.0 |
| CT-10 | 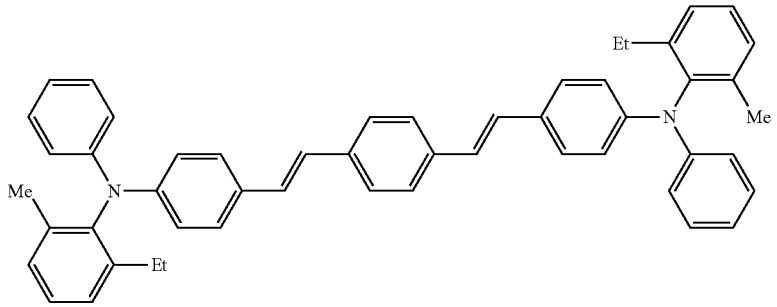 | 701.0 |
| CT-11 | 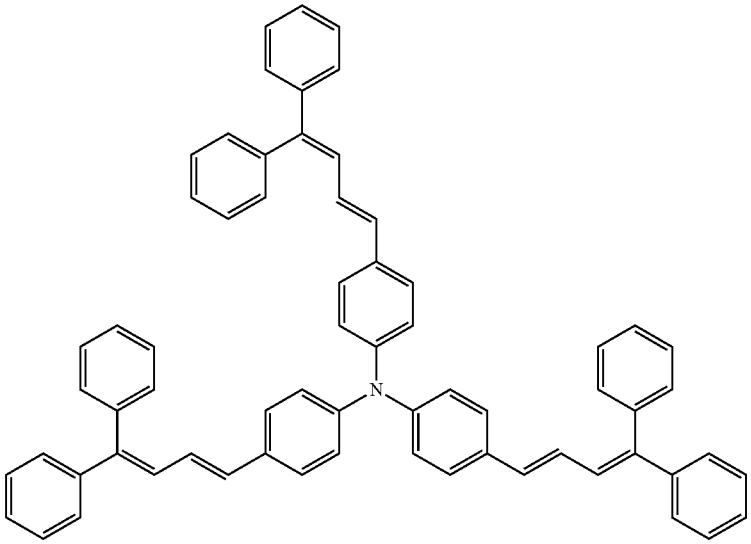 | 857.4 |

The charge transport material used in the second and subsequent charge transporting layers preferably has an absolute value of the difference in ionization potential of preferably 0.2 eV or less, and more preferably 0.1 eV or less, from the viewpoint of matching with the charge transport material α used in the first charge transport layer. The same charge transport material may be used in the first charge transport layer and the second charge transport layer. In this case, it is preferable that the charge transport material α used in the first charge transport layer is fewer than the charge transport material β used in the second charge transport layer from the viewpoint of abrasion resistance. That is, the content of the charge transport material α relative to 100 parts by mass of the binder resin A in the first charge transporting layer is preferably equal to or less than the content of the charge transport material β relative to 100 parts by mass of the binder resin B in the second charge transport layer. Even in a case where different charge transport materials are used in the first and second charge transport layers, high scratch resistance can be obtained by setting the contents of the charge transport materials to satisfy the above relationship, which is preferable.

From the viewpoint of abrasion resistance, the content of the charge transport material α relative to 100 parts by mass of the binder resin A in the first charge transport layer is preferably 10 parts by mass to 40 parts by mass, and more preferably 15 parts by mass to 30 parts by mass.

From the viewpoint of electrical properties and adhesiveness, the content of the charge transport material β relative to 100 parts by mass of the binder resin B in the second charge transport layer is preferably 40 parts by mass to 100 parts by mass, and more preferably 50 parts by mass to 90 parts by mass.

The total film thickness of the charge transport layer is not particularly limited and depends on the setting of the image forming apparatus. The total film thickness is usually 5 μm or more, preferably 10 μm or more from the viewpoint of long life, image stability, and charging stability, and is usually 50 μm or less, preferably 45 μm or less, more preferably 30 μm or less, and particularly preferably 25 μm or less from the viewpoint of high resolution.

The relative film thickness ratio of the first and second charge transport layers is also not particularly limited and depends on the setting of the life of the image forming apparatus. The film thickness of the first charge transport layer to the thickness of the second charge transport layer is preferably 10:90 to 70:30, and more preferably 15:85 to 50:50.

<Other Additives>

The charge generation layer and the charge transport layer may contain known additives such as an antioxidant, plasticizer, an ultraviolet absorber, an electron-withdrawing compound, a leveling agent, and a visible light shielding agent for the purposes of enhancing the film forming properties, flexibility, coating property, contamination resistance, gas resistance, light resistance, and the like.

<Methods for Forming Each Layer>

The layers for constituting the photoreceptor are formed in the following manner. The substances to be contained in each layer are dissolved or dispersed in a solvent to obtain a coating liquid. The coating liquids thus obtained for the respective layers are successively applied on a support by a known technique, such as dip coating, spray coating, nozzle coating, bar coating, roll coating, or blade coating, and dried. The constituent layers are formed by repeating this application and drying step for each layer.

Although solvents or dispersion medium to be used in preparation of the coating liquid is not limited to particular solvents or dispersion media, specific examples thereof include alcohols such as methanol, ethanol, propanol, and 2-methoxyethanol, ethers such as tetrahydrofuran, 1,4-dioxane, and dimethoxyethane, esters such as methyl formate, ethyl acetate, ketones such as acetone, methyl ethyl ketone, cyclohexanone, and 4-methoxy-4-methyl-2-pentanone, aromatic hydrocarbons such as benzene, toluene, and xylene, chlorinated hydrocarbons such as dichloromethane, chloroform, 1,2-dichloroethane, 1,1,2-trichloroethane, 1,1,1-trichloroethane, tetrachloroethane, 1,2-dichloropropane, and trichloroethylene, nitrogen-containing compounds such as n-butylamine, isopropanolamine, diethylamine, triethanolamine, ethylenediamine, and triethylenediamine, and aprotic polar solvents such as acetonitrile, N-methylpyrrolidone, N,N-dimethylformamide, and dimethyl sulfoxide. One selected from these may be used alone, or two or more selected from these may be used in any desired combination.

Although the amount of the solvent or dispersion medium to be used is not particularly limited, the amount thereof is preferably adjusted, as appropriate, in accordance with the intended purpose of each layer and nature of the selected solvent and dispersion media so as to set properties such as the solid content concentration or viscosity of the coating liquid, to be in desired ranges.

In order to form the charge transport layer according to the present invention by laminating two or more layers, it is preferable not to erode the second charge transport layer at the time of forming the first charge transport layer, and it is preferable to use ring coating or spray coating at the time of forming the first charge transport layer.

Regarding the drying of the coating liquid, it is preferable that after room-temperature drying, the coating liquid is dried with heating in a temperature range of, usually, 30° C. to 200° C. for 1 minute to 2 hours either in a stationary atmosphere or with air blowing. The heating temperature may be constant, or the heating for drying may be performed while changing the heating temperature.

<<Image Forming Apparatus>>

Next, description regarding an embodiment of an image forming apparatus including the electrophotographic photoreceptor according to the present invention (image forming apparatus of the present invention) will be provided with reference to FIG. 1, which illustrates the configuration of main components of the apparatus. However, embodiments of the present invention are not limited to the following description, and the embodiments can be freely modified without departing from the spirit and scope of the present invention.

As illustrated in FIG. 1, the image forming apparatus is provided with an electrophotographic photoreceptor 1, a charging device 2, an exposure device 3, and a developing device 4, and if necessary, is further provided with a transfer device 5, a cleaning device 6, and a fixing device 7.

The electrophotographic photoreceptor 1 is not particularly limited as long as it is the electrophotographic photoreceptor of the invention described above. FIG. 1 illustrates, as an example thereof, a drum-shaped photoreceptor obtained by forming the photosensitive layer described above on the surface of a cylindrical conductive support. The charging device 2, the exposure device 3, the developing device 4, the transfer device 5, and the cleaning device 6 are disposed along the peripheral surface of this electrophotographic photoreceptor 1.

The charging device 2, which is the one that charges the electrophotographic photoreceptor 1, uniformly charges a surface of the electrophotographic photoreceptor 1 to a predetermined potential. Examples of typical charging devices include non-contact corona charging devices such as a corotron and a scorotron, or contact charging devices (direct charging devices) that charges the photoreceptor by bringing a charging member to which a voltage is being applied into contact with the surface of the photoreceptor.

Examples of the contact charging devices include charging rollers and charging brushes. The charging device shown in FIG. 2, as an example of the charging device 2, is a roller type-charging device (charging roller). Charging rollers are typically produced by integrally molding a resin and additives such as a plasticizer with a metallic shaft and may have a multilayer structure as necessary. As the voltage to be applied for the charging, a direct-current voltage only can be used or an alternating current superimposed on a direct current is also usable.

The exposure device 3 is not particularly limited as long as it is an exposure device that is capable of exposing the electrophotographic photoreceptor 1 charged by the charging device 2 and forming an electrostatic latent image on the photosensitive surface of the electrophotographic photoreceptor 1. Specific examples thereof include a halogen lamp, fluorescent lamp, laser such as semiconductor laser or He—

Ne laser, and LED. Exposure may be performed by an internal photoreceptor exposure technique, or the like. Although the wavelength of the exposing light can be selected at will, use can be made of, for example, monochromatic light having a wavelength of 780 nm, monochromatic light having a slightly short wavelength in a range of 600 nm to 700 nm, monochromatic light having a short wavelength in a range of 380 nm 500 nm, or the like.

The developing device 4 forms an electrostatic latent image formed on the electrophotographic photoreceptor. For example, the developing device 4 forms the toner T supplied by a supply roller 43 into a thin layer using a regulating member (developing blade) 45 and charges the toner T to a predetermined polarity (here, the same polarity as that of the charge potential of the photoreceptor 1: positive polarity) by means of frictional electrification, transfers the toner while supporting the toner with a developing roller 44, and brings the toner into contact with the surface of the photoreceptor 1.

When the charged toner T supported with the developing roller 44 comes into contact with the surface of the photoreceptor 1, a toner image corresponding to the electrostatic latent image is formed on the photosensitive surface of the photoreceptor 1.

Although a toner T can be selected at will, use can be made of polymerization toners obtained by methods such as suspension polymerization, emulsion polymerization, and the like in addition to powdery toners. In particular, in a case where polymerization toners are used, preferred are toners having a small particle diameter of around 4 μm to 8 μm, and use can be made of the toner particles having various shapes from a nearly spherical shape to potato-shaped shape apart from a sphere. Polymerization toners, which are excellent in terms of uniformity in charging and transferability, are preferably used for increasing image quality.

The transfer device 5 transfers the toner image formed by the developing device onto a recording paper P. The type of the transfer device 5 is not limited, and devices using any technique such as an electrostatic transfer technique, pressure transfer technique, adhesive transfer technique, or the like, e.g., corona transfer, roller transfer, or belt transfer can be used. In FIG. 1, illustrates that the transfer device 5 includes a transfer charger, a transfer roller, and a transfer belt configured to face the electrophotographic photoreceptor 1. This transfer device 5 applies a predetermined voltage (transfer voltage) in a polarity opposite to the charge potential of the toner T, and thereby transfers a toner image formed on the electrophotographic photoreceptor 1 onto a recording paper (paper and print medium) P.

The toner T remaining on the photosensitive surface of the photoreceptor 1 without being transferred by the cleaning device 6 is removed. The type of the cleaning device 6 is not particularly limited, and use can be made of any cleaning device such as a brush cleaner, a magnetic brush cleaner, an electrostatic brush cleaner, a magnetic roller cleaner, and a blade cleaner. The cleaning device 6 scrapes off the remaining toner attached to the photoreceptor 1 with a cleaning member to collect the remaining toner. However, in a case where the remaining toner on the surface of the photoreceptor 1 is either small or almost non-existent, the cleaning device 6 may be omitted.

The electrophotographic apparatus (image forming apparatus) configured to as above records an image as follows. That is, first, the charging device 2 charges a surface (photosensitive surface) of the photoreceptor 1 to a predetermined potential. At this time, the charging device 2 may charge the photosensitive surface of the photoreceptor using a direct-current voltage or may charge the same using an alternate-current voltage superimposed with a direct-current voltage.

Next, the charged photosensitive surface of the photoreceptor 1 is exposed to light by the exposure device 3 according to an image to be recorded and form an electrostatic latent image on the photosensitive surface. Subsequently, the developing device 4 develops the electrostatic latent image formed on the photosensitive surface of the photoreceptor 1.

The developing device 4 forms the toner T supplied by a supply roller 43 into a thin layer using a regulating member (devcloping blade) 45, charges the toner T to a predetermined polarity (here, the same polarity as that of the charge potential of the photoreceptor 1: positive polarity) by means of frictional electrification, transfers the toner while supporting the toner with a developing roller 44, and brings the toner into contact with the surface of the photoreceptor 1.

When the charged toner T supported with the developing roller 44 comes into contact with the surface of the photoreceptor 1, a toner image corresponding to the electrostatic latent image is formed on the photosensitive surface of the photoreceptor 1. Subsequently, the toner image is transferred by the transfer device 5 onto the recording paper P. Thereafter, the toner (remaining toner) remaining on the photosensitive surface of the photoreceptor 1 without being transferred is removed by the cleaning device 6.

After the transfer of the toner image onto the recording paper P, the recording paper P is made to pass through the fixing device 7 and the toner image is thermally fixed onto the recording paper P, whereby obtaining a final image.

In addition to the above-described configuration, the image forming apparatus may be configured, for example, to be capable of performing a charge elimination step. The charge elimination step is a step of carrying out eliminating the charges by exposing the electrophotographic photoreceptor to light, and as a charge elimination device, a fluorescent lamp or LED may, for example, be used. Further, regarding the intensity of the light used in the charge elimination step, light having exposure energy at least three times the exposure light is frequently used. From the standpoints of miniaturization and energy saving, the charge elimination step is preferably omitted.

The image forming apparatus may further be modified such that the image forming apparatus is configured, for example, to be capable of performing a pre-exposing step or an auxiliary charging step, or to be capable of offset printing, or further may be configured as a full-color tandem system employing multiple kinds of toners.

In the present invention, one or two or more devices selected from the group consisting of the charging device 2, the exposure device 3, the developing device 4, the transfer device 5, the cleaning device 6, and the fixing device 7 may be combined with the electrophotographic photoreceptor 1 to configure an integrated cartridge (hereinafter, referred as "electrophotographic photoreceptor cartridge" as appropriate) so that this electrophotographic photoreceptor cartridge can be mounted on and demounted from the main body of an electrophotographic apparatus such as a copy machine or a laser-beam printer.

EXAMPLE

Hereinafter, embodiments of the present invention will be described more specifically with reference to examples. It is to be noted that the following examples are presented for the purpose of explaining the present invention in detail, and the present invention is not limited to the following examples, and can be arbitrarily modified and carried out within the scope not departing from the gist of the invention.

Example 1

<Preparation of Undercoat Layer Forming Coating Liquid>

Rutile type titanium oxide ("TTO55N" manufactured by Ishihara Sangyo Kaisha, Ltd.) having an average primary particle diameter of 40 nm and 3% by mass of methyl dimethoxysilane ("TSL8117" manufactured by Toshiba Silicone Co., Ltd.) were mixed in a Henschel mixer, and the surface treated titanium oxide thus obtained was dispersed by a ball mill in a mixed solvent of methanol/l-propanol (mass ratio, 7:3) so as to prepare a dispersion slurry of surface treated titanium oxide. The dispersion slurry, a mixed solvent of methanol/1-propanol/toluene, and pellets of a copolymerized polyamide containing ε-caprolactam [a compound represented by the following Formula (A)], bis (4-amino-3-methylcyclohexyl) methane [a compound represented by the following Formula (B)], hexamethylenediamine [a compound represented by the following Formula (C)], decamethylenedicarboxylic acid [a compound represented by the following Formula (D)], and octadecamethylenedicarboxylic acid [a compound represented by the following Formula (E)] in a composition molar ratio of 60%, 15%, 5%, 15% and 5% were stirred and mixed with heating, so as to dissolve the polyamide pellets. Thereafter, the mixture was subjected to an ultrasonic dispersion treatment, so as to prepare a undercoat layer forming coating liquid containing methanol/1-propanol/toluene in a mass ratio of 7/1/2 and surface treated titanium oxide/copolymerized polyamide in a mass ratio of 3/1, and having a solid content concentration of 18.0% by mass.

A

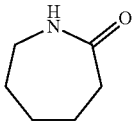

B

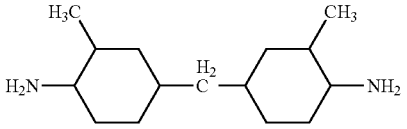

C

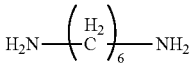

D

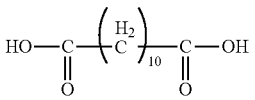

-continued

E

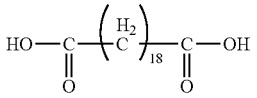

<Preparation of Charge Generation Layer Forming Coating Liquid>

First, as the charge generation substance, 20 parts of α-form (also called B-form) oxytitanium phthalocyanine and 280 parts of 1,2-dimethoxyethane were mixed with each other, and the mixture was subjected to a pulverization/dispersion treatment for 1 hour by using a sand grinding mill. Subsequently, the resultant pulverized treatment liquid was mixed with a binder liquid obtained by dissolving 10 parts of polyvinyl butyral (trade name "Denka Butyral" #6000C, manufactured by Denki Kagaku Kogyo K.K.) in a mixed solution containing 255 parts of 1,2-dimethoxyethane and 85 parts of 4-methoxy-4-methyl-2-pentanone, and with 230 parts by mass of 1,2-dimethoxyethane, so as to prepare a charge generation layer forming coating liquid.

<Preparation of Second Charge Transport Layer Forming Coating Liquid>

100 parts of a polycarbonate resin (PC1) having the following repeating structural unit (viscosity-average molecular weight: 80,000), 60 parts of the compound represented by CT-7 as a charge transport material, 4 parts of an antioxidant (trade name: Irganox 1076, manufactured by Ciba Specialty Chemicals Inc.) as an additive, 1 part of tribenzylamine, and 0.05 part of silicone oil (trade name KF 96, manufactured by Shin-Etsu Silicone Co., Ltd.) were dissolved in 660 parts of a mixed solvent of tetrahydrofuran/toluene (8/2 (mass ratio)), so as to prepare a second charge transport layer forming coating liquid.

(PC1)

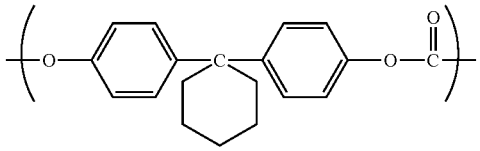

<Preparation of First Charge Transport Layer Forming Coating Liquid>

100 parts of a polyarylate resin (PE1) having the following repeating structural unit (viscosity-average molecular weight: 65,000), 20 parts of the compound represented by CT-7 as a charge transport material, 2 parts of an antioxidant (trade name: Irganox 1076, manufactured by Ciba Specialty Chemicals Inc.) as an additive, 0.5 part of tribenzylamine, and 0.05 part of silicone oil (trade name KF 96, manufactured by Shin-Etsu Silicone Co., Ltd.) were dissolved in 600 parts of a mixed solvent of tetrahydrofuran/toluene (8/2 (mass ratio)), so as to prepare a first charge transport layer forming coating liquid.

(PE1)

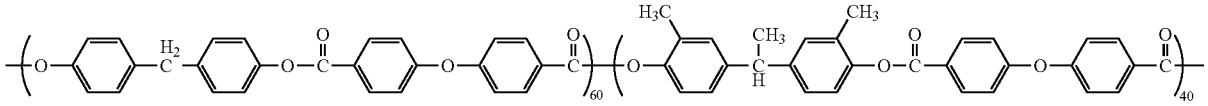

<Preparation of Photoreceptor>

The undercoat layer forming coating liquid prepared as above, the charge generation layer forming coating liquid, and the second charge transport layer forming coating liquid were sequentially applied to a cylinder made of aluminum, of which the surface was subjected to a rough cutting process and was washed cleanly, having an external diameter of 30 mm, a length of 255 mm, and a thickness of 0.75 mm by using a dip coating method, and drying was performed so as to form an undercoat layer, a charge generation layer, and a second charge transport layer such that the film thicknesses thereof after drying respectively were 0.13 prm, 0.4 μm, and 20 μm. The second charge transport layer was dried at 125° C. for 20 minutes. After cooling to room temperature, the first charge transport layer forming coating liquid prepared above was coated onto the second charge transport layer by a ring coating method, and a first charge transport layer was formed such that the film thickness after drying was 10 μm. The first charge transport layer was dried at 125° C. for 20 minutes.

<Electrical Property Test>

Using an electrophotography property evaluation apparatus manufactured in accordance with the measurement standards of The Society of Electrophotography of Japan (as described in Foundation and Application of Electrophotographic Technique (Continued), CORONA PUBLISHING CO., LTD., published on Nov. 15, 1996, Pages 404 to 405), the photoreceptor was charged such that the initial surface potential of the above photoconductor was about −700 V, and the light of a halogen lamp was converted to monochromatic light of 780 nm by an interference filter, so as to obtain the surface potential (the potential of exposure surface; referred to as VL) when exposure was performed at 0.6 $\mu J/cm^2$. The time from exposure to potential measurement was 57 milliseconds. The measurement environment was performed at 25° C. and 50% RH. The smaller the absolute value of VL is, the better the electrical properties are. The results are shown in Table 2.

<Image Test>

The obtained photoreceptor was mounted on a photoreceptor cartridge of a monochrome multifunction printer M4580 (47 pages of A4 paper per minute printing, nonmagnetic single component polymerized toner, contact charging) manufactured by Samsung Electronics Co., Ltd., and continuous printing of 40,000 sheets was performed at a coverage rate of 5% under a temperature of 25° C. and a relative humidity of 50%. Image evaluation and measurement of abrasion amount of the photosensitive layer (charge transport layer) (quantitative determination of film thickness reduction amount) were performed. The abrasion amount was measured with an eddy current type film thickness meter at approximately equal intervals in the axial direction of the photoreceptor and measured with three axes different by 120° in the rotation direction, so as to calculate an average. The results are shown in Table 2.

<Measurement of Elastic Deformation Ratio of Binder Resin>

A coating liquid obtained by dissolving 100 parts by mass of a binder resin, 40 parts by mass of a charge transport material represented by the following Formula (1), and 0.05 part by mass of a silicone oil (manufactured by Shin-Etsu Silicone Co., Ltd., trade name KF96), in tetrahydrofuran/toluene (8/2 (mass ratio)) is coated on a glass substrate and dried, such that the film thickness after drying is 20 μm, so as to prepare a measurement sample.

FORMULA (1)

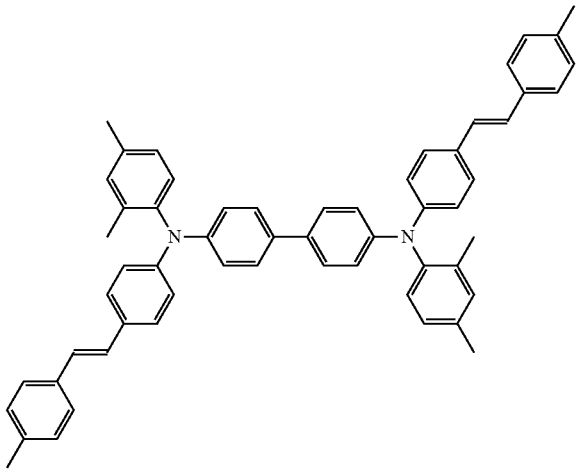

For this sample, the elastic deformation ratio was measured using an Fischer microscopic hardness meter FISCHERSCOPE HM 2000 under an environment of a temperature of 25° C. and a relative humidity of 50%. For the measurement, a Vickers square pyramid diamond indenter having a facing angle of 136° was used. The measurement conditions were set as follows.

(Measurement Conditions)

Maximum indentation load: 5 mN

Loading time required: 10 seconds

Unloading time required: 10 seconds

A profile was acquired by continuously reading a load applied to the indenter and an indentation depth under the load, and plotting on the Y axis and the X axis as shown in FIG. 2. The value of the elastic deformation ratio obtained by the following equation was taken as the elastic deformation ratio of the binder resin.

$$\text{Elastic deformation ratio (\%)}=(We/Wt)\times 100$$

In the above equation, Wt represents the total workload (nJ) and indicates the area surrounded by A-B-D-A in FIG. 2, and We represents the elastic deformation workload (nJ), and indicates the area surrounded by C-B-D-C in FIG. 2.

The obtained elastic deformation ratios are shown in Table 2.

<Adhesiveness Test>

The adhesiveness of the charge transport layer was evaluated by a cross-cut test (cutter knife cut, tape peeling method) of 25 squares (5×5 square) based on JIS K5600: 1999. The results were evaluated in the following five grades. The results are shown in Table 2.

5: no peeling

4: peeling within 2 places. acceptable.

3: peeling within 3 to 5 places. acceptable.

2: peeling within 6 to 15 places. unacceptable.

1: peeling at 16 places or more. unacceptable.

Example 2

A photoreceptor was prepared in the same manner as in Example 1 except that the preparation of the second charge transport layer forming coating liquid and the preparation of the first charge transport layer forming coating liquid in Example 1 were changed as follows, and then evaluation was performed. The results are shown in Table 2.

<Preparation of Second Charge Transport Layer Forming Coating Liquid>

100 parts of a polycarbonate resin (PC2) having the following repeating structural unit (viscosity-average molecular weight: 30,000), 60 parts of the compound represented by the above CT-5 as a charge transport material, 4 parts of an antioxidant (trade name: Irganox 1076, manufactured by Ciba Specialty Chemicals Inc.) as an additive, and 0.05 part of silicone oil (trade name KF 96, manufactured by Shin-Etsu Silicone Co., Ltd.) were dissolved in 560 parts of a mixed solvent of tetrahydrofuran/toluene (8/2 (mass ratio)), so as to prepare a second charge transport layer forming coating liquid.

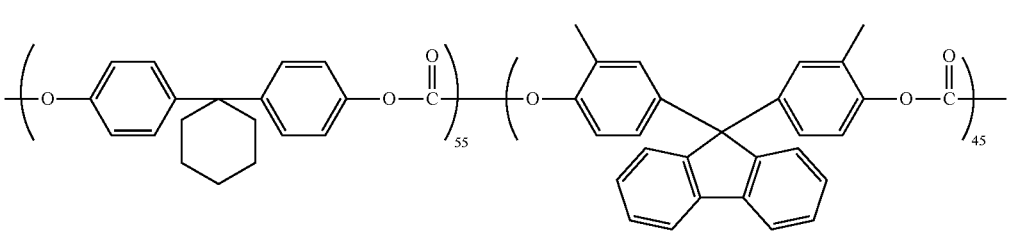

(PC2)

<Preparation of First Charge Transport Layer Forming Coating Liquid>

100 parts of a polyarylate resin (PE1) having the above repeating structural unit (viscosity-average molecular weight: 65,000), 20 parts of the compound represented by the above CT-5 as a charge transport material, 2 parts of an antioxidant (trade name: Irganox 1076, manufactured by Ciba Specialty Chemicals Inc.) as an additive, and 0.05 part of silicone oil (trade name KF 96, manufactured by Shin-Etsu Silicone Co., Ltd.) were dissolved in 600 parts of a mixed solvent of tetrahydrofuran/toluene (8/2 (mass ratio)), so as to prepare a first charge transport layer forming coating liquid.

Example 3

A photoreceptor was prepared in the same manner as in Example 1 except that the preparation of the second charge transport layer forming coating liquid and the preparation of the first charge transport layer forming coating liquid in Example 1 were changed as follows, and then evaluation was performed. The results are shown in Table 2.

<Preparation of Second Charge Transport Layer Forming Coating Liquid>

100 parts of a polycarbonate resin (PC3) having the following repeating structural unit (viscosity-average molecular weight: 50,000), 60 parts of the compound represented by the above CT-5 as a charge transport material, 4 parts of an antioxidant (trade name: Irganox 1076, manufactured by Ciba Specialty Chemicals Inc.) as an additive, and 0.05 part of silicone oil (trade name KF 96, manufactured by Shin-Etsu Silicone Co., Ltd.) were dissolved in 610 parts of a mixed solvent of tetrahydrofuran/toluene (8/2 (mass ratio)), so as to prepare a second charge transport layer forming coating liquid.

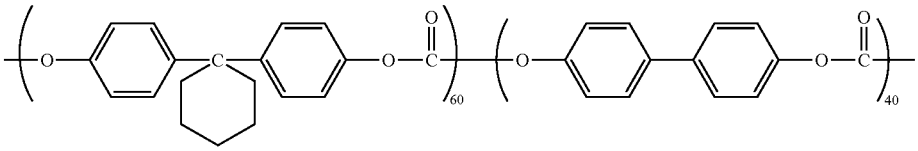

(PC3)

<Preparation of First Charge Transport Layer Forming Coating Liquid>

100 parts of a polyarylate resin (PE2) having the following repeating structural unit (viscosity-average molecular weight: 40,000), 20 parts of the compound represented by the above CT-5 as a charge transport material, 2 parts of an antioxidant (trade name: Irganox 1076, manufactured by Ciba Specialty Chemicals Inc.) as an additive, and 0.05 part of silicone oil (trade name KF 96, manufactured by Shin-Etsu Silicone Co., Ltd.) were dissolved in 600 parts of a mixed solvent of tetrahydrofuran/toluene (8/2 (mass ratio)), so as to prepare a first charge transport layer forming coating liquid.

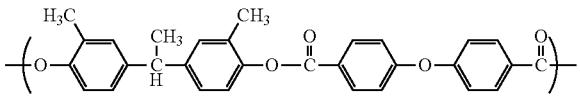

(PE2)

Example 4

A photoreceptor was prepared in the same manner as in Example 1 except that the preparation of the second charge transport layer forming coating liquid and the preparation of the first charge transport layer forming coating liquid in Example 1 were changed as follows, and then evaluation was performed. The results are shown in Table 2.

<Preparation of Second Charge Transport Layer Forming Coating Liquid>

100 parts of a polycarbonate resin (PC3) having the above repeating structural unit (viscosity-average molecular weight: 50,000), 80 parts of the compound represented by the following CT-A as a charge transport material, 4 parts of an antioxidant (trade name: Irganox 1076, manufactured by Ciba Specialty Chemicals Inc.) as an additive, and 0.05 part of silicone oil (trade name KF 96, manufactured by Shin-Etsu Silicone Co., Ltd.) were dissolved in 610 parts of a mixed solvent of tetrahydrofuran/toluene (8/2 (mass ratio)), so as to prepare a second charge transport layer forming coating liquid.

(CT-A)

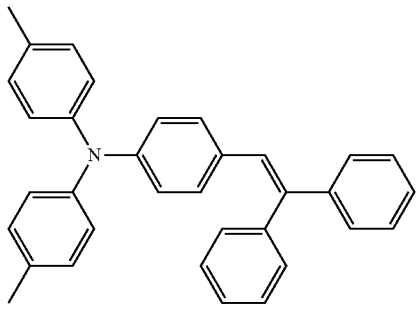

<Preparation of First Charge Transport Layer Forming Coating Liquid>

100 parts of a polyarylate resin (PE3) having the following repeating structural unit (viscosity-average molecular weight: 40,000, tercphthalic acid: isophthalic acid=45:55 (molar ratio)), 20 parts of the compound represented by the above CT-9 as a charge transport material, 2 parts of an antioxidant (trade name: Irganox 1076, manufactured by Ciba Specialty Chemicals Inc.) as an additive, and 0.05 part of silicone oil (trade name KF 96, manufactured by Shin-Etsu Silicone Co., Ltd.) were dissolved in 500 parts of a mixed solvent of tetrahydrofuran/toluene (8/2 (mass ratio)), so as to prepare a first charge transport layer forming coating liquid.

(PE3)

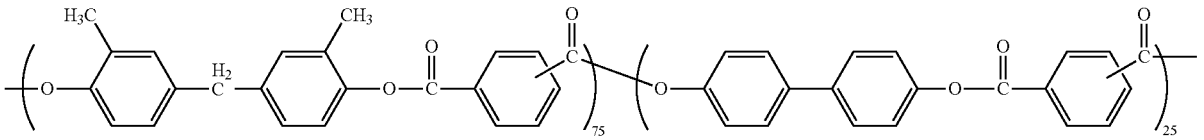

Example 5

A photoreceptor was prepared in the same manner as in Example 3, except that the preparation of the second charge transport layer forming coating liquid in Example 3 was changed as follows, and then evaluation was performed. The results are shown in Table 2.

<Preparation of Second Charge Transport Layer Forming Coating Liquid>

100 parts of a polycarbonate resin (PC5) having the repeating structural unit same as the above PC1 and a molecular weight different from the above PC1 (viscosity-average molecular weight: 20,000), 60 parts of the compound represented by CT-5 as a charge transport material, 4 parts of an antioxidant (trade name: Irganox 1076, manufactured by Ciba Specialty Chemicals Inc.) as an additive, 1 part of tribenzylamine, and 0.05 part of silicone oil (trade name KF 96, manufactured by Shin-Etsu Silicone Co., Ltd.) were dissolved in 560 parts of a mixed solvent of tetrahydrofuran/toluene (8/2 (mass ratio)), so as to prepare a second charge transport layer forming coating liquid.

Example 6

A photoreceptor was prepared in the same manner as in Example 1, except that the preparation of the first charge transport layer forming coating liquid in Example 1 was changed as follows, and then evaluation was performed. The results are shown in Table 2.

<Preparation of First Charge Transport Layer Forming Coating Liquid>

100 parts of a polyarylate resin (PE1) having the above repeating structural unit (viscosity-average molecular weight: 65,000), 20 parts of the compound represented by CT-4 as a charge transport material, 2 parts of an antioxidant (trade name: Irganox 1076, manufactured by Ciba Specialty Chemicals Inc.) as an additive, 0.5 part of tribenzylamine, and 0.05 part of silicone oil (trade name KF 96, manufactured by Shin-Etsu Silicone Co., Ltd.) were dissolved in 600 parts of a mixed solvent of tetrahydrofuran/toluene (8/2 (mass ratio)), so as to prepare a first charge transport layer forming coating liquid.

Comparative Example 1

A photoreceptor was prepared in the same manner as in Example 1 except that the preparation of the first charge transport layer forming coating liquid in Example 1 was changed as follows, without using the second charge transport layer forming coating liquid nor forming the second charge transport layer, and then evaluation was performed. The results are shown in Table 2. The photoreceptor was remarkably inferior in adhesiveness, and all peeled off in a cross-cut adhesiveness test.

<Preparation of First Charge Transport Layer Forming Coating Liquid>

100 parts of a polyarylate resin (PE1) having the above repeating structural unit (viscosity-average molecular weight: 65,000), 20 parts of the compound represented by CT-7 as a charge transport material, 2 parts of an antioxidant (trade name: Irganox 1076, manufactured by Ciba Specialty Chemicals Inc.) as an additive, 0.5 part of tribenzylamine, and 0.05 part of silicone oil (trade name KF 96, manufactured by Shin-Etsu Silicone Co., Ltd.) were dissolved in 600 parts of a mixed solvent of tetrahydrofuran/toluene (8/2 (mass ratio)), so as to prepare a first charge transport layer forming coating liquid.

Comparative Example 2

A photoreceptor was prepared in the same manner as in Example 3, except that the preparation of the second charge transport layer forming coating liquid in Example 3 was changed as follows, and then evaluation was performed. The results are shown in Table 2. The abrasion property deteriorated as compared with Example 3 using the same first charge transport layer.

<Preparation of Second Charge Transport Layer Forming Coating Liquid>

100 parts of a polycarbonate resin (PC4) having the following repeating structural unit (viscosity-average molecular weight: 40,000), 80 parts of the compound represented by the above CT-5 as a charge transport material, 4 parts of an antioxidant (trade name: Irganox 1076, manufactured by Ciba Specialty Chemicals Inc.) as an additive, and 0.05 part of silicone oil (trade name KF 96, manufactured by Shin-Etsu Silicone Co., Ltd.) were dissolved in 600 parts of a mixed solvent of tetrahydrofuran/toluene (8/2 (mass ratio)), so as to prepare a second charge transport layer forming coating liquid.

image density was low from the beginning, and the image density was further lowered while repeating, the image test was stopped halfway. When the surface potential was measured, it was found that the residual potential remarkably increased.

<Preparation of Second Charge Transport Layer Forming Coating Liquid>

100 parts of a polycarbonate resin (PC4) having the above repeating structural unit (viscosity-average molecular weight: 40,000), 80 parts of the compound represented by the above CT-A as a charge transport material, 4 parts of an antioxidant (trade name: Irganox 1076, manufactured by Ciba Specialty Chemicals Inc.) as an additive, and 0.05 part of silicone oil (trade name KF 96, manufactured by Shin-Etsu Silicone Co., Ltd.) were dissolved in 600 parts of a mixed solvent of tetrahydrofuran/toluene (8/2 (mass ratio)), so as to prepare a second charge transport layer forming coating liquid.

<Preparation of First Charge Transport Layer Forming Coating Liquid>

100 parts of a polyarylate resin (PE2) having the above repeating structural unit (viscosity-average molecular (PC4)

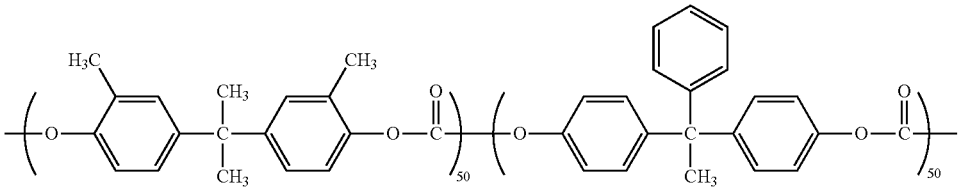

Comparative Example 3

A photoreceptor was prepared in the same manner as in Example 1 except that the preparation of the second charge transport layer forming coating liquid in Example 1 was changed as follows and the film thickness of the second charge transport layer was changed to 15 μm, and then evaluation was performed. The results are shown in Table 2. In Comparative Example 3, the abrasion amount was increased and the abrasion resistance was deteriorated as compared with Example 1.

<Preparation of Second Charge Transport Layer Forming Coating Liquid>

100 parts of a polycarbonate resin (PC4) having the above repeating structural unit (viscosity-average molecular weight: 40,000), 60 parts of the compound represented by CT-7 as a charge transport material, 4 parts of an antioxidant (trade name: Irganox 1076, manufactured by Ciba Specialty Chemicals Inc.) as an additive, 1 part of tribenzylamine, and 0.05 part of silicone oil (trade name KF 96, manufactured by Shin-Etsu Silicone Co., Ltd.) were dissolved in 600 parts of a mixed solvent of tetrahydrofuran/toluene (8/2 (mass ratio)), so as to prepare a second charge transport layer forming coating liquid.

Comparative Example 4

A photoreceptor was prepared in the same manner as in Example 1 except that the preparation of the second charge transport layer forming coating liquid and the preparation of the first charge transport layer forming coating liquid in Example 1 were changed as follows, and then evaluation was performed. The results are shown in Table 2. Since the weight: 40,000), 20 parts of the compound represented by the above CT-A as a charge transport material, 2 parts of an antioxidant (trade name: Irganox 1076, manufactured by Ciba Specialty Chemicals Inc.) as an additive, and 0.05 part of silicone oil (trade name KF 96, manufactured by Shin-Etsu Silicone Co., Ltd.) were dissolved in 600 parts of a mixed solvent of tetrahydrofuran/toluene (8/2 (mass ratio)), so as to prepare a first charge transport layer forming coating liquid.

Comparative Example 5

A photoreceptor was prepared in the same manner as in Comparative Example 4, except that the preparation of the first charge transport layer forming coating liquid in Comparative Example 4 was changed as follows, and then evaluation was performed. The results are shown in Table 2. In Comparative Example 5, although the image density was improved as compared with Comparative Example 4, the abrasion amount was very large.

Comparative Example 6

A photoreceptor was prepared in the same manner as in Example 4, except that the preparation of the first charge transport layer forming coating liquid in Example 4 was changed as follows, and then evaluation was performed. The results are shown in Table 2. Since the image density was low from the beginning, and the image density was further lowered while repeating, the image test was stopped halfway. When the surface potential was measured, it was found that the residual potential remarkably increased.

<Preparation of First Charge Transport Layer Forming Coating Liquid>

100 parts of a polyarylate resin (PE2) having the above repeating structural unit (viscosity-average molecular weight: 40,000), 50 parts of the compound represented by the above CT-B as a charge transport material, 2 parts of an antioxidant (trade name: Irganox 1076, manufactured by Ciba Specialty Chemicals Inc.) as an additive, and 0.05 part of silicone oil (trade name KF 96, manufactured by Shin-Etsu Silicone Co., Ltd.) were dissolved in 560 parts of a mixed solvent of tetrahydrofuran/toluene (8/2 (mass ratio)), so as to prepare a first charge transport layer forming coating liquid.

(CT-B)

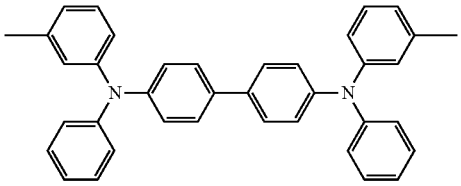

Comparative Example 7

A photoreceptor was prepared in the same manner as in Example 4, except that the preparation of the first charge transport layer forming coating liquid in Example 4 was changed as follows, and then evaluation was performed. The results are shown in Table 2. Since the image density was low from the beginning, and the image density was further lowered while repeating, the image test was stopped half-way. When the surface potential was measured, it was found that the residual potential remarkably increased.

<Preparation of First Charge Transport Layer Forming Coating Liquid>

100 parts of a polyarylate resin (PE2) having the above repeating structural unit (viscosity-average molecular weight: 40,000), 50 parts of the compound represented by the above CT-C as a charge transport material, 2 parts of an antioxidant (trade name: Irganox 1076, manufactured by Ciba Specialty Chemicals Inc.) as an additive, and 0.05 part of silicone oil (trade name KF 96, manufactured by Shin-Etsu Silicone Co., Ltd.) were dissolved in 560 parts of a mixed solvent of tetrahydrofuran/toluene (8/2 (mass ratio)), so as to prepare a first charge transport layer forming coating liquid.

(CT-C)

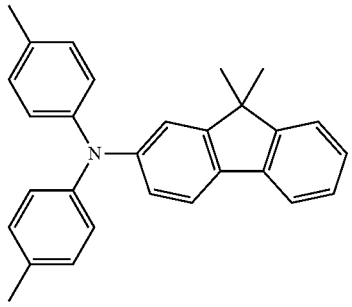

TABLE 3

| | First charge transport layer | | | | Second charge transport layer | | | | | | | |
|---|---|---|---|---|---|---|---|---|---|---|---|---|
| | Film thickness | Binder resin | T1 (%) | Charge transport material (molecular weight) | Film thickness | Binder resin | T2 (%) | Charge transport material (molecular weight) | T1-T2 (%) | VL | Abrasion amount | Adhesiveness |
| Example 1 | 10 | PE1 | 47 | CT-7 (884.2) | 20 | PC1 | 44 | CT-7 (884.2) | 3 | 33 | 1.69 | 5 |
| Example 2 | 10 | PE1 | 47 | CT-5 (745.0) | 20 | PC2 | 45 | CT-5 (745.0) | 2 | 56 | 1.65 | 4 |
| Example 3 | 10 | PE2 | 46 | CT-5 (745.0) | 20 | PC3 | 44 | CT-5 (745.0) | 2 | 58 | 1.84 | 3 |
| Example 4 | 10 | PE3 | 45 | CT-9 (701.0) | 20 | PC3 | 44 | CT-A (451.6) | 1 | 86 | 1.75 | 3 |
| Example 5 | 10 | PE2 | 46 | CT-5 (745.0) | 20 | PC5 | 42 | CT-5 (745.0) | 4 | 61 | 2.05 | 5 |
| Example 6 | 10 | PE1 | 47 | CT-4 (686) | 20 | PC1 | 44 | CT-7 (884.2) | 3 | 45 | 1.71 | 4 |
| Comparative Example 1 | 20 | PE1 | 47 | CT-7 (884.2) | — | — | — | — | — | 18 | 1.90 | 1 |
| Comparative Example 2 | 10 | PE2 | 46 | CT-5 (745.0) | 20 | PC4 | 40 | CT-5 (745.0) | 6 | 55 | 2.22 | 5 |
| Comparative Example 3 | 10 | PE1 | 47 | CT-7 (884.2) | 15 | PC4 | 40 | CT-7 (884.2) | 7 | 31 | 2.24 | 5 |
| Comparative Example 4 | 10 | PE2 | 46 | CT-A (451.6) | 20 | PC4 | 40 | CT-A (451.6) | 6 | 308 | — | 5 |
| Comparative Example 5 | 10 | PE2 | 46 | CT-A (451.6) | 20 | PC4 | 40 | CT-A (451.6) | 6 | 127 | 5.10 | 5 |
| Comparative Example 6 | 10 | PE2 | 46 | CT-B (516) | 20 | PC3 | 44 | CT-A (451.6) | 2 | 255 | — | 3 |
| Comparative Example 7 | 10 | PE2 | 46 | CT-C (481) | 20 | PC3 | 44 | CT-A (451.6) | 2 | 430 | — | 3 |

While the present invention has been described in detail and with reference to specific embodiments, it will be apparent to those skilled in the art that various changes and modifications can be made without departing from the spirit and scope of the present invention. This application is based on Japanese Patent Application (Japanese Patent Application No. 2016-191959) filed on Sep. 29, 2016, the contents of which are incorporated herein by reference.

REFERENCE SIGNS LIST

1 Photoreceptor (electrophotographic photoreceptor)
2 Charging device (charging roller; charging unit)
3 Exposure device (exposure unit)
4 Developing device (developing unit)
5 Transfer device
6 Cleaning device
7 Fixing device
41 Developing tank
42 Agitator
43 Supply roller
44 Developing roller
45 Regulating member
71 Upper fixing member (fixing roller)
72 Lower fixing member (fixing roller)
73 Heating device
T Toner
P Recording paper (paper and print medium)

The invention claimed is:

1. An electrophotographic photoreceptor comprising:

a conductive support; and at least a charge generation layer and a charge transport layer on the conductive support, wherein the charge transport layer includes at least two layers of a first charge transport layer which is an outermost layer and a second charge transport layer which is in contact with the first charge transport layer, wherein the first charge transport layer comprises a binder resin A and the second charge transport layer comprises a binder resin B, wherein an elastic deformation ratio of the binder resin A contained in the first charge transport layer is T1(%) and an elastic deformation ratio of the binder resin B contained in the second charge transport layer is T2(%) such that T1 and T2 satisfy a relationship of $\{0 \leq (T1-T2) \leq 4\}$, wherein the elastic deformation ratio T1(%) is obtained by measuring a thin film, which corresponds to the charge transport layer, using a micro hardness tester with 5 mN of maximum indentation load, in which the thin film is obtained by coating with a coating liquid on a glass substrate and dried so that the film thickness after drying is 20 μm and the coating liquid is obtained by dissolving 100 parts by mass of a binder resin A, 40 parts by mass of a charge transport material represented by the following formula (1), and 0.05 part by mass of a silicone oil in tetrahydrofurantoluene (8/2 (mass ratio)), the elastic deformation ratio T2(%) is obtained by measuring the same thin film except that the binder resin A is changed to the binder resin B, using a micro hardness tester with 5 mN of maximum indentation load,

FORMULA (1)

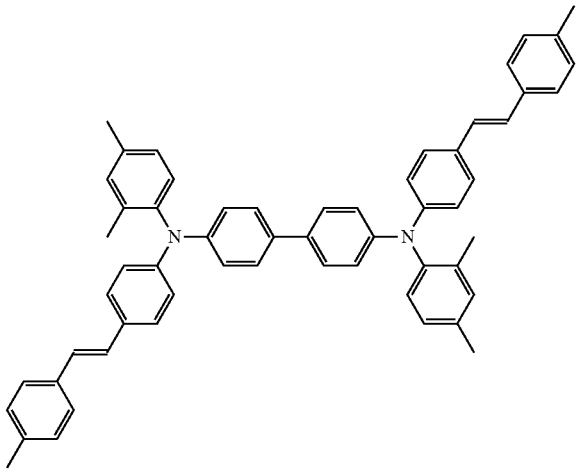

the first charge transport layer contains a charge transport material α having a molecular weight of 600 or more, and wherein the binder resin A and the binder resin B have different monomer units from each other.

2. The electrophotographic photoreceptor according to claim 1, wherein the T1 is 44% to 49%.

3. The electrophotographic photoreceptor according to claim 1, wherein the T2 is 43% to 47%.

4. The electrophotographic photoreceptor according to claim 1, wherein the second charge transport layer comprises a charge transport material γ having a molecular weight of 600 or more.

5. The electrophotographic photoreceptor according to claim 1, wherein a content of the charge transport material α relative to 100 parts by mass of the binder resin A in the first charge transport layer is 10 parts by mass to 40 parts by mass.

6. The electrophotographic photoreceptor according to claim 4, wherein the content of the charge transport material α relative to 100 parts by mass of the binder resin A in the first charge transport layer is equal to or less than a content of a charge transport material γ relative to 100 parts by mass of the binder resin B in the second charge transport layer.

7. The electrophotographic photoreceptor according to claim 1, wherein the binder resin A is a polyarylate resin and the binder resin B is a polycarbonate resin.

8. An electrophotographic photoreceptor cartridge, comprising:

the electrophotographic photoreceptor according to claim 1; and at least one device selected from the group consisting of a charging device which charges the electrophotographic photoreceptor, an exposure device which exposes the charged electrophotographic photoreceptor to form an electrostatic latent image, a developing device which develops the electrostatic latent image formed on the electrophotographic photoreceptor, a transfer device which transfers a developed toner, a cleaning device which cleans the remaining toner on the electrophotographic photoreceptor, and a fixing device which fixes the transferred toner onto a print medium.

9. An image forming apparatus comprising: the electrophotographic photoreceptor according to claim 1; a charging device which charges the electrophotographic photoreceptor: an exposure device which exposes the charged electrophotographic photoreceptor to form an electrostatic latent image; and a developing device which develops the electrostatic latent image formed on the electrophotographic photoreceptor.

* * * * *